US006722937B1

(12) United States Patent
Ludwig et al.

(10) Patent No.: US 6,722,937 B1
(45) Date of Patent: Apr. 20, 2004

(54) SEALING OF FLAT-PANEL DEVICE

(75) Inventors: Paul N. Ludwig, Livermore, CA (US); Theodore S. Fahlen, San Jose, CA (US); Shinji Kanagawa, San Jose, CA (US); Jennifer Y. Sun, Sunnyvale, CA (US)

(73) Assignees: Candescent Technologies Corporation, Los Gatos, CA (US); Candescent Intellectual Property Services, Inc., Los Gatos, CA (US); Sony Corporation, Tokyo (JP)

( * ) Notice: Subject to any disclaimer, the term of this patent is extended or adjusted under 35 U.S.C. 154(b) by 0 days.

(21) Appl. No.: 09/628,584

(22) Filed: Jul. 31, 2000

(51) Int. Cl.[7] ..... H01J 9/26

(52) U.S. Cl. ..... 445/25
(58) Field of Search ..... 425/24, 25

(56) References Cited

U.S. PATENT DOCUMENTS

| | | | | |
|---|---|---|---|---|
| 1,931,311 A | * | 10/1933 | Young | 285/201 |
| 3,777,281 A | * | 12/1973 | Hochuli | 228/124.6 |
| 3,874,549 A | | 4/1975 | Hascoe | 220/200 |
| 3,879,629 A | * | 4/1975 | Durand | 445/25 |
| 4,021,219 A | | 5/1977 | Stockdale et al. | 65/43 |
| 4,618,801 A | | 10/1986 | Kakino | 313/495 |
| 4,683,154 A | | 7/1987 | Benson et al. | 428/34 |
| 5,275,328 A | * | 1/1994 | Lodge et al. | 228/118 |
| 5,424,605 A | | 6/1995 | Lovoi | 313/422 |
| 5,477,105 A | | 12/1995 | Curtin et al. | 313/422 |
| 5,489,321 A | | 2/1996 | Tracy et al. | 65/43 |
| 5,548,181 A | | 8/1996 | Jones | 313/309 |
| 5,589,731 A | | 12/1996 | Fahlen et al. | 313/495 |
| 5,693,111 A | | 12/1997 | Kadowski et al. | 65/43 |
| 5,697,825 A | | 12/1997 | Dynka et al. | 445/25 |
| 5,807,154 A | | 9/1998 | Watkins | 445/25 |
| 5,820,435 A | | 10/1998 | Cooper et al. | 445/25 |
| 5,827,102 A | | 10/1998 | Watkins et al. | 445/25 |
| 5,964,630 A | | 10/1999 | Slusarczuk et al. | 445/25 |
| 5,977,706 A | | 11/1999 | Cho et al. | 313/553 |
| 6,036,567 A | | 3/2000 | Watkins | 445/25 |
| 6,109,994 A | | 8/2000 | Cho et al. | 445/25 |
| 6,139,390 A | | 10/2000 | Pothoven et al. | 445/41 |

FOREIGN PATENT DOCUMENTS

WO WO 98/26440 6/1998

OTHER PUBLICATIONS

Branst et al. "The Challenge of Flat Panel Display Sealing," *Semiconductor Int'l* .. Jan. 1996, pp. 109–112.
Jellison et al., "Laser Materials Processing at Sandia National Laboratories," Applications of Lasers and Electro–optics, Conference, Oct. 17–20, 1994, sponsored by Dept. of Energy, 10 pages.
Tannas, *Flat–Panel Displays and CRTs* (Van Nostrand Reinhold), Section 79, 1985, pp. 217–221.

(List continued on next page.)

*Primary Examiner*—Kenneth J. Ramsey
(74) *Attorney, Agent, or Firm*—Ronald J. Meetin

(57) ABSTRACT

A flat-panel display is hermetically sealed by a process in which a first plate structure (30) is positioned generally opposite a second plate structure (32) such that sealing material (34) provided over the second plate structure lies between the plate structures. In a gravitational sealing technique, the first plate structure is positioned vertically below the second plate structure. The sealing material is heated so that it moves vertically downward under gravitational influence to meet the first plate structure and seal the plate structures together. In a global-heating gap-jumping technique, the plate structures and sealing material are globally heated to cause the sealing material to jump a gap between the sealing material and the first plate structure. When the first plate structure is positioned vertically above the second plate structure, the sealing material moves vertically upward to meet the first plate structure and close the gap.

84 Claims, 13 Drawing Sheets

OTHER PUBLICATIONS

Zimmerman et al., "Glass Panel Alignment and Sealing for Flat–Panel Displays" Viewgraph Presentation, NCAICM Workshop, Contract No. F33615–94–C–1415, Nov. 30–Dec. 2, 1994, 29 viewgraphs.

Zimmerman et al., "Glass Panel Alignment and Sealing for Flat–Panel Displays," Contract Summary, ARPA High Definition Systems Program, ARPA High Definition Information Exchange Conference, Apr. 30–May 3, 1995, 2 pages.

* cited by examiner

SEALING OF FLAT-PANEL DEVICE

FIELD OF USE

This invention relates to techniques for sealing flat-panel devices such as flat-panel displays.

BACKGROUND ART

A flat-panel device typically contains two generally flat plates positioned opposite each other. A flat-panel display is a type of flat-panel device utilized for displaying information. The two plates in a flat-panel display are commonly termed the faceplate and backplate. The faceplate, which provides the display's viewing surface, is part of a faceplate structure containing one or more layers or regions formed over the faceplate. The backplate is similarly part of a backplate structure containing one or more layers or regions formed over the backplate. The two plate structures are sealed together, typically through an outer wall, to form a sealed enclosure.

A flat-panel display utilizes mechanisms such as cathode rays (electrons), plasmas, and liquid crystals to display information on the faceplate. Flat-panel displays which employ these three mechanisms are generally referred to as cathode-ray tube ("CRT") displays, plasma displays, and liquid-crystal displays. The constituency and arrangement of the display's two plate structures depend on the type of mechanism utilized to display information on the faceplate.

In a flat-panel CRT display, electron-emissive elements are typically provided over the backplate. Light-emissive elements are situated over the faceplate. When the electron-emissive elements are appropriately excited, they emit electrons that strike the light-emissive elements causing them to emit light visible on the faceplate. By appropriately controlling the electron flow from the backplate structure to the faceplate structure, a suitable image is displayed on the faceplate. The electron flow needs to occur in a highly evacuated environment for the CRT display to operate properly and to avoid rapid degradation in performance. It is thus critical to hermetically seal a flat-panel CRT display.

FIGS. 1*a*–1*c* (collectively "FIG. 1") illustrate a conventional technique for sealing a flat-panel CRT display of the field-emission type, often referred to simply as a field-emission display ("FED"). The components of the FED being sealed in FIG. 1 include backplate structure 10, faceplate structure 12, outer wall 14, and multiple spacer walls 16 situated between plates structures 10 and 12 for preventing outside forces, such as air pressure, from collapsing or otherwise damaging the FED.

At the point shown in FIG. 1*a*, spacer walls 16 are mounted on faceplate structure 12, and outer wall 14 is connected to faceplate structure 12 through frit (sealing glass) 18 provided along the faceplate edge of outer wall 14. Frit 20 is situated along the backplate edge of outer wall 14. A pump-out tube (not shown) is typically affixed to backplate structure 10 for later evacuating the sealed FED. Prior to the sealing operation, backplate structure 10 is physically separate from the composite structure formed with faceplate structure 12, outer wall 14, and spacer walls 16.

Structures 10 and 12/14/16 are placed in an alignment system 22, aligned to each other, and brought into physical contact along frit 20 as shown in FIG. 1*b*. Alignment system 22 is located in, or is placed in, an oven 24. After being aligned and brought into contact along frit 20, structures 10 and 12/14/16 are slowly heated in air to a sealing temperature ranging from 450° C. to greater than 600° C. Frit 20 melts. The FED is subsequently cooled down to room temperature. As frit 20 cools down, it seals composite structure 12/14/16 to backplate structure 10.

At or near the end of the cooldown, the FED is removed from alignment system 22 and oven 24. The pressure in the interior of the FED is brought down to the desired vacuum level by removing air through the pump-out tube. The pump-out tube is then closed. Aside from the pump-out tube, FIG. 1*c* depicts the final hermetically sealed FED.

During the sealing operation, the upper edge of outer wall 14, including frit 18 and frit 20, is initially slightly higher than the upper edges of spacer walls 16. As frit 20 melts, it compresses somewhat in the direction, commonly referred to as the z direction, perpendicular to plate structures 10 and 12 until spacer walls 16 meet backplate structure 10. Frit 18 may also compress in the z direction during the sealing operation. Hence, plates structures 10 and 12 move relative to each other in the z direction as the FED is being sealed. A similar type of z motion would occur if a rectangular ring of frit were substituted for composite outer wall 14/18/20.

A side effect of motion in the z direction is that faceplate structure 12 sometimes moves relative to backplate structure 10 in a direction perpendicular to the z direction. Hence, the alignment of plate structures 10 and 12 is sometimes degraded as a result of the z motion of structures 10 and 12. Due primarily to differences in the coefficients of thermal expansion of plate structures 10 and 12 and alignment system 22, the degradation in alignment can occur despite the use of system 22. It would be desirable to hermetically seal a flat-panel display, especially a flat-panel CRT display such as an FED, according to a technique that largely avoids z motion between the displays two plate structures and thus avoids alignment degradation due to such z motion.

As frit 20 melts and compresses in the z direction, frit 20 normally spreads laterally over faceplate structure 12. The lateral area of structure 12 can be increased in the peripheral area outside the viewing area to allow for frit 20 to spread laterally. However, it is typically desirable that the peripheral display area be as small a fraction as possible of the total lateral area of structure 12. Accordingly, increasing the lateral area of structure 12 to allow room for frit 20 to spread is disadvantageous.

In addition, frit 20 may occasionally spread laterally beyond the normal area allocated for the spreading of frit 20 and damage components of the FED. A similar disadvantage would occur if composite outer wall 14/18/20 were replaced with a ring, again rectangular, of frit. In sealing two plate structures of a flat-panel display, especially a flat-panel CRT display such as an FED, together through a sealing structure, it would be desirable to have a technique for suitably restricting lateral spreading of the sealing material in the sealing structure.

PCT Patent Publication WO 98/26440 discloses a local-energy gap-jumping technique for sealing the backplate structure and faceplate structure of a flat-panel display. A rectangular frame of sealing material, typically frit, is sealed to the faceplate structure. The sealing frame laterally surrounds a group of spacer walls that extend further away from the faceplate structure than does the sealing frame. The backplate structure is placed vertically above the faceplate structure so that the sealing frame and spacer walls are situated between the two plate structures. The backplate structure lies directly on the spacer walls. Because the spacer walls are taller than the sealing frame at this point, a gap is present between the backplate structure and the sealing frame.

The two plate structures in PCT Patent Publication WO 98/26440 are held in a desired alignment using a suitable tacking mechanism. Energy is then transferred locally to portions of the sealing frame close to the backplate structure. The local energy, typically light energy provided from a laser or focused lamp, causes the sealing material to jump the backplate-structure-to-sealing-frame gap and hermetically seal the plate structures together.

By using spacer walls that are initially taller than the sealing frame, the sealing technique of PCT Patent Publication WO 98/26440 largely avoids undesired z motion during the sealing operation. However, utilization of a laser, focused lamp, or other local-energy producing mechanism to direct energy locally onto the sealing frame can sometimes be relatively time-consuming and thus unduly expensive. It would be desirable to have a technique that can be implemented rapidly, and relatively inexpensively, to seal a flat-panel display such as an FED.

GENERAL DISCLOSURE OF THE INVENTION

The present invention furnishes techniques for sealing a flat-panel device so as to achieve a hermetic seal while avoiding the above-mentioned disadvantages of the prior art. The sealing techniques of the invention are especially suitable for sealing a flat-panel CRT display, such as an FED, in which the interior of the display needs to be at a high vacuum during display operation. Nonetheless, each of the present sealing techniques can be applied to a display which requires a strong seal even though the display's interior may not be at a high vacuum during display operation.

In one aspect of the invention, sealing of first and second plate structures of a flat-panel device to each other is performed under the influence of gravity. More particularly, sealing material is provided in a specified pattern over the second plate structure. The first plate structure is positioned vertically below the second plate structure so that the sealing material lies between the two plate structures. As used here in describing gravitational sealing of two plate structures, the term "vertically" means vertically relative to the body, such as the earth, which provides the gravitation. The sealing material is then heated so that it moves downward under gravitational influence to contact the first plate structure and seal the plate structures together.

The plate structures are preferably maintained in a largely fixed positional relationship to each other during the heating step. For instance, the positioning of the first plate structure below the second plate structure is preferably conducted in such a way that the plate structures are spaced vertically apart from each other in largely a fixed manner. That is, the spacing between the plate structures along any vertical line through the plate structures is approximately constant. This positional relationship is then maintained during the heating step using, for example, an intermediate mechanism situated between the plate structures.

Importantly, by maintaining the plate structures in largely a fixed positional relationship to each other during the heating step, there is a essentially no z motion of one of the plate structures relative to the other during the heating step. Inasmuch as such z motion during the sealing of a pair of plate structures to each other often causes degradation in the alignment of the plate structures to each other, sealing the first and second plate structures together under the influence of gravity with the plate structures held in largely a fixed positional relationship to each other so as to avoid such z motion also avoids associated alignment degradation.

The heating step during the gravitational sealing operation preferably entails globally heating the sealing material and the two plate structures. The term "global" or "globally" as used here in describing a heating operation performed on parts of a device means that the heat is applied in a generally non-selective manner to the parts of the device. A global heating operation is thus basically the converse of a local heating operation in which energy is directed selectively to certain material largely intended to receive the energy without being significantly directed to nearby material not intended to receive the energy. Global heating is typically less time-consuming, and thus less expensive, than local heating. As a result, using global heating to perform the heating step of the present gravitational sealing operation helps keep the sealing cost down.

In another aspect of the invention, one or more restricting structures are utilized to limit the area where first and second plate structures of a flat-panel device are sealed to each other. The seal-restricting structure or structures thereby prevent the sealing material from spreading to sensitive device areas and degrading the device.

Specifically, one or two seal-restricting structures are provided over the first plate structure. Sealing material is provided in a specified pattern over the second plate structure. The plate structures are then positioned generally opposite each other so that the sealing material and the restricting structure or structures lie between the plate structures. If only one restricting structure is provided over the first plate structure, the sealing material is situated opposite a location close to the restricting structure. When two restricting structures are provided over the first plate structure, the sealing material is situated opposite a location between the restricting structures.

The sealing material is heated to seal the plate structures together. If one restricting structure is provided over the first plate structure, the sealing material contacts the first plate structure close to that restricting structure. The restricting structure largely prevents the sealing material from spreading laterally over the restricting structures and contacting the first plate structure laterally beyond the restricting structure. When two restricting structures are placed over the second plate structure, the sealing material contacts the first plate structure between the restricting structures. The two restricting structures then largely prevent the sealing material from spreading laterally over the restricting structure and contacting the first plate structure laterally beyond one or both of the restricting structures. In either case, use of the restricting structure or structures typically prevents the sealing material from spreading laterally in such a manner as to degrade the flat-panel device. Also, the lateral area of the flat-panel device need not be significantly increased to allow for lateral spreading of the sealing material.

In a further aspect of the invention, first and second plate structures of a flat-panel device are sealed together according to a global-heating gap-jumping technique. In particular, sealing material is again provided in a specified pattern over the second plate structure. The two plate structures are then positioned opposite each other so that the sealing material lies between the plate structures. The positioning step is done in such a way that a gap separates the first plate structure from the sealing material provided over the second plate structure.

The first plate structure is preferably positioned vertically above the second plate structure. Similar to what was said above about the meaning of the term "vertically" in connection with the gravitational sealing technique of the invention, the term "vertically" as used in connection with the present global-heating gap-jumping technique means vertically relative to the underlying major gravitational body above which the global-heating gap-jumping technique is performed. With this in mind, the preferred orientation of the first plate structure above the second plate structure in the global-heating gap-jumping technique is opposite to the orientation in which the plate structures are arranged during the heating step of the gravitational sealing technique.

The sealing material and plate structures in the present global-heating gap-jumping technique are then globally heated to cause the sealing material to bridge the gap between the plate structures and seal them together. In the preferred case where the first plate structure is positioned vertically above the second plate structure, the sealing material provided over the second plate structure moves vertically upward to jump the gap. By using global heating to produce gap jumping, the cost of the sealing operation can be kept relatively low.

The present gravitational sealing technique can be performed with one or two seal-restricting structures. The same applies to the global-heating gap-jumping sealing technique of the invention. By maintaining the plate structures in largely a fixed positional relationship to each other during the heating step, the resultant sealing technique achieves both the advantages of using one or two seal-restricting structures and the advantages of the gravitational or global-heating gap-jumping technique. That is, device alignment degradation caused by z motion during the sealing operation is largely avoided, the sealing material is largely prevented from spreading over undesirable device areas and damaging sensitive device elements, and the device's lateral area need not be significantly increased to accommodate spreading of the sealing material.

In short, use of the present sealing techniques enables a flat-panel device to be hermetically sealed in a manner that avoids critical degradation problems. The sealing operation can be performed in a highly cost-efficient manner. The invention thereby provides a substantial advance over the prior art.

BRIEF DESCRIPTION OF THE DRAWINGS

Like reference symbols are employed in the drawings and in the description of the preferred embodiments to represent the same, or very similar, item or items.

DESCRIPTION OF THE PREFERRED EMBODIMENTS

General Considerations

A flat-panel display sealed according to the present invention has two plate structures referred to as the backplate structure and the faceplate structure. As used here, the "exterior" surface of the faceplate structure is the surface on which the display's image is visible to a viewer. The opposite side of the faceplate structure is referred to as its "interior" surface even though part of the interior surface of the faceplate structure is normally outside the enclosure formed by sealing the faceplate structure to the backplate structure through an outer wall. Likewise, the surface of the backplate structure situated opposite the interior surface of the faceplate structure is referred to as the "interior" surface of the backplate structure even though part of the interior surface of the backplate structure is normally outside the display's sealed enclosure. The side of the backplate structure opposite to its interior surface is referred to as the "exterior" surface of the backplate structure.

Gravitational Sealing

Figure 1A:
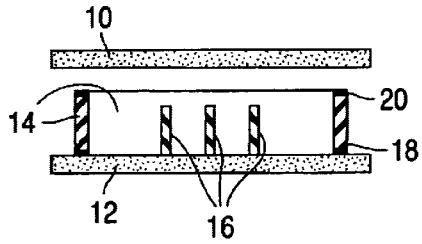
Fig. 1a PRIOR ART
FIGS. 1*a*–1*c* are cross-sectional side views representing steps in a conventional process for sealing a flat-panel CRT display.
Figure 1B:
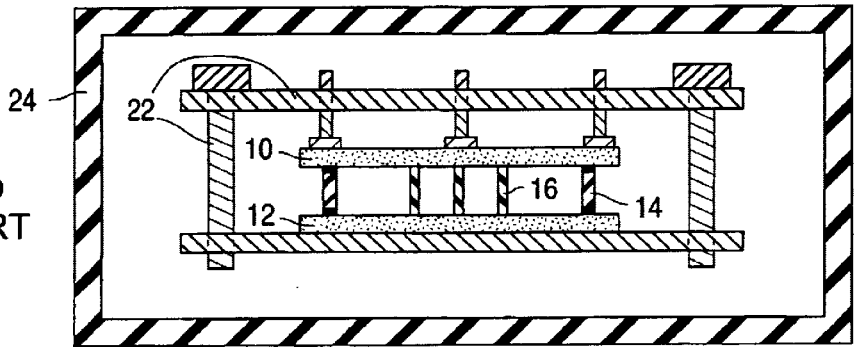
Fig. 1b PRIOR ART
Figure 1C:
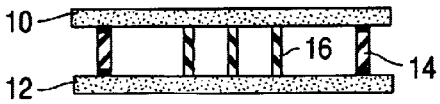
Fig. 1c PRIOR ART
Figure 2A:
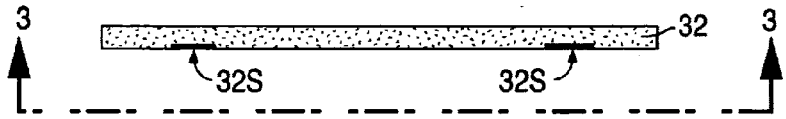
FIGS. 2*a*–2*i* are cross-sectional side views representing steps in a process the utilizes gravity in accordance with the invention for sealing a flat-panel display.
Figure 2B:
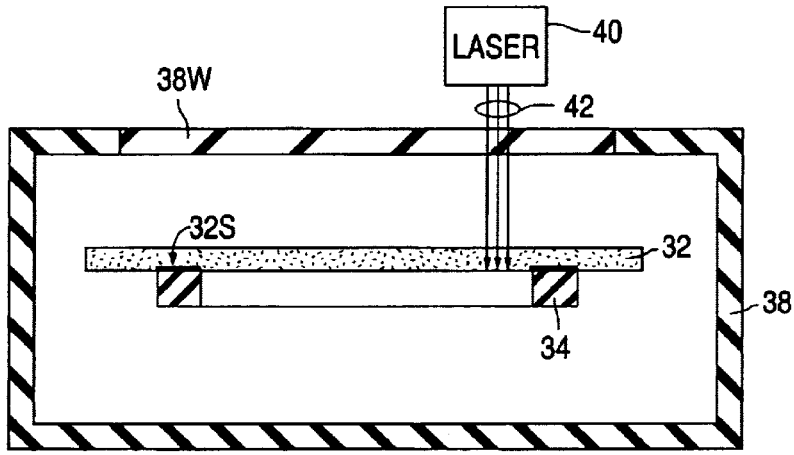
Figure 2C:
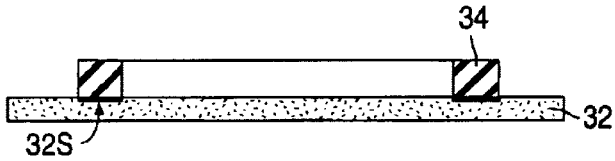
Figure 2D:
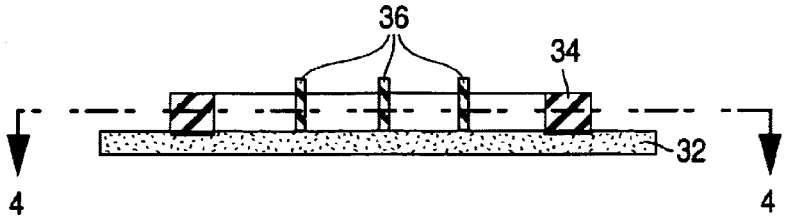
Figure 2E:
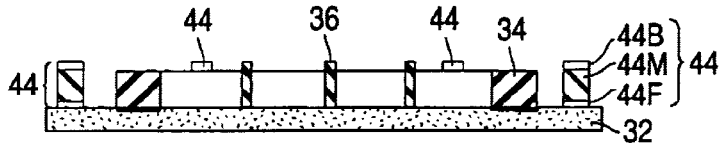
Figure 2F:
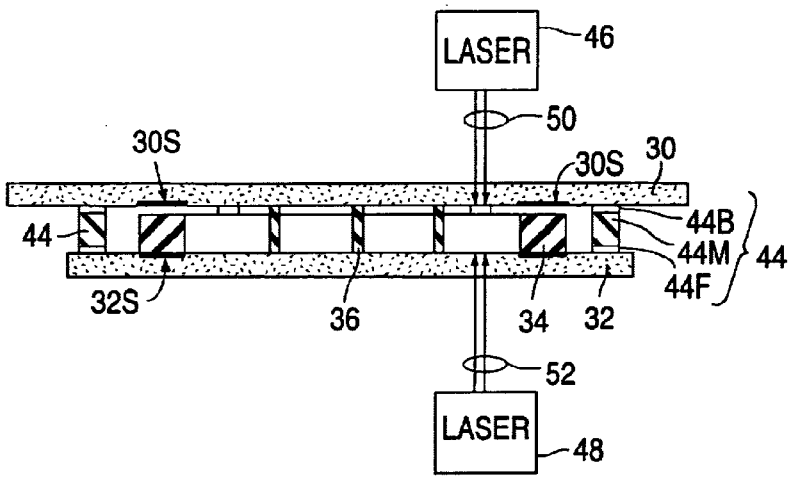
Figure 2G:
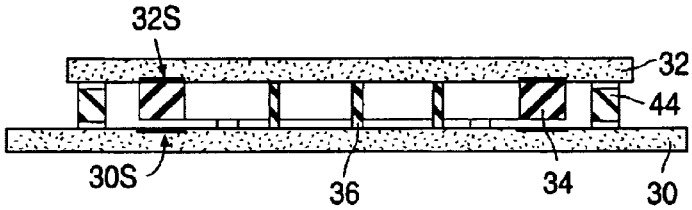
Figure 2H:
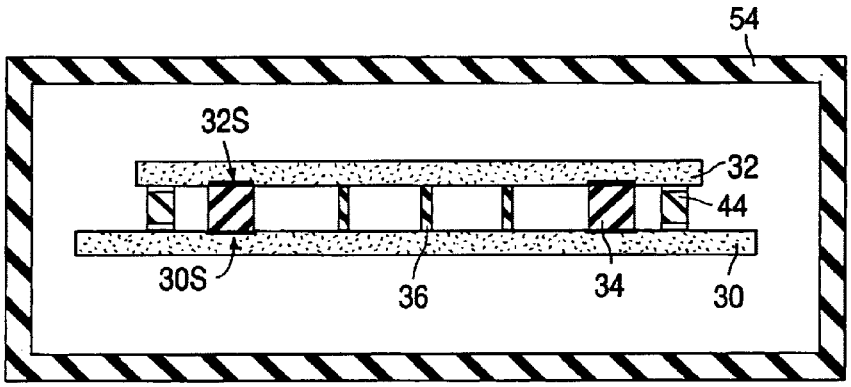
Figure 2I:
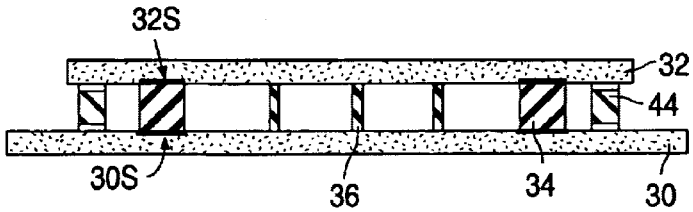

FIGS. 2*a*–2*i* (collectively "FIG. 2") illustrate a general gravity-based technique for hermetically sealing a flat-panel display according to the invention. The components of the flat-panel display sealed according to the process of FIG. 2 are a backplate structure 30, a faceplate structure 32, an outer wall 34, and an internal spacer system consisting of a group of spacer walls 36. Backplate structure 30, faceplate structure 32, outer wall 34, and spacer walls 36 are fabricated separately. FIG. 2*a* only depicts faceplate structure 32. FIG. 2*i* depicts all of components 30, 32, 34, and 36 after plate structures 30 and 32 have been sealed together through outer wall 34.

Backplate structure 30 and faceplate structure 32 are generally rectangular in shape. The internal constituency of plate structures 30 and 32 is not shown in the drawings. However, backplate structure 30 consists of a backplate and one or more layers or regions formed over the interior surface of the backplate. Faceplate structure 32 consists of a transparent faceplate and one or more layers or regions formed over the interior surface of the faceplate.

Outer wall 34 is arranged in a specified pattern, normally a rectangle as viewed perpendicular to plate structure 30 or 32. More particularly, wall 34 normally consists of four sub-walls arranged in the desired rectangular pattern. Spacer walls 36 maintain a constant spacing between plate structures 30 and 32 in the sealed display, and enable the display to withstand external forces such as air pressure. The display sealing operation normally involves raising the components of the flat-panel display to elevated temperature. To reduce the likelihood of cracking the display, especially during cooldown to room temperature, outer wall 34 is typically chosen to consist of material having a coefficient of thermal expansion ("CTE") that approximately matches the CTEs of the backplate and the faceplate.

A flat-panel display sealed according to the process of FIG. 2 can be any of a number of different types of flat-panel displays such as CRT displays, plasma displays, vacuum fluorescent displays, liquid-crystal displays, and light-emitting diode displays. In flat-panel CRT displays of the field-emission type and in some flat-panel CRT displays of the thermionic-emission type, backplate structure 30 contains a two-dimensional array of rows and columns of electron-emissive regions situated over the backplate. Structure 30 is then an electron-emitting device.

Specifically, backplate structure 30 in a flat-panel field emission CRT display typically has a group of emitter electrodes that extend across the backplate in a row direction. A dielectric layer lies over the emitter electrodes. A row of the electron-emissive regions also overlie each emitter electrode. At each location for an electron-emissive region, a large number of openings, each occupied by an electron-emissive element, extend through the dielectric layer down to a corresponding one of the emitter electrodes.

A patterned gate layer is situated on the dielectric layer. Each electron-emissive element is exposed through a corresponding opening in the gate layer. A group of control electrodes, either created from the patterned gate layer or from a separate control-electrode layer that contacts the gate layer, extend over the dielectric layer in a column direction perpendicular to the row direction. Each control electrode extends along one column of the electron-emissive regions. The emission of electrons from the electron-emissive region at the intersection of each emitter electrode and each control electrode is controlled by applying appropriate voltages to the emitter and column electrodes.

Alternatively, the emitter electrodes can extend in the column direction while the control electrodes extend in the row direction. Although the row direction is typically the direction in which a line of the display's image is presented, the terms "row" and "column" are arbitrary and can be reversed in meaning.

Faceplate structure 32 in the field-emission display (again, "FED") contains a two-dimensional array of light-emissive elements provided over the interior surface of the transparent faceplate. An anode is situated adjacent to the light-emissive elements in structure 32. The anode may be positioned over the light-emissive elements. In that case, the anode typically consists of a thin layer of electrically conductive light-reflective material, such as aluminum, through which the emitted electrons can readily pass to strike the light-emissive elements. U.S. Pat. Nos. 5,424,605 and 5,477,105 describe examples of FEDs having faceplate structure 32 arranged in the preceding manner.

Alternatively, the anode in the FED can be formed with a thin layer of electrically conductive transparent material, such as indium tin oxide, located between the faceplate and the light-emissive elements. In either case, the anode is provided with a suitably high voltage that draws emitted electrons toward target light-emissive elements in faceplate structure 32. As the electrons strike the light-emissive elements, they emit light visible on the exterior surface of the faceplate to form a desired image.

The thickness of outer wall 34 is normally 1–6 mm, typically 2.5–3.5 mm. Although the dimensions have been adjusted in FIG. 2 to facilitate illustration of the components of the flat-panel display, the height of outer wall 34 is usually of the same order of magnitude as the outer wall thickness. For example, the outer wall height is normally 1–1.5 mm, typically 1.2 mm.

The four sub-walls of outer wall 34 can be formed individually and later joined to one another directly or through four comer pieces. The four sub-walls can also be a single piece of appropriately shaped material. Outer wall 34 normally consists of frit, such as Ferro 2004 frit combined with filler and a stain, arranged in a rectangular annulus. The frit in outer wall 34 normally melts at temperature of 300–600° C. The frit melting temperature is much less, typically 100° C. less, than the melting temperature of any of the materials of plate structures 30 and 32 and spacer walls 36.

Spacer walls 36 typically extend in the row direction. Each pair of spacer walls 36 is normally separated by multiple rows of pixels. Spacer walls 36 typically consist primarily of material which is electrically insulating or highly electrically resistive (but still slightly electrically conductive). For simplicity, spacer walls 36 are illustrated in FIG. 2 using shading for electrically insulating material. When the flat-panel display is an FED, one or more electrodes (not shown) are typically provided along one or both faces of each spacer wall 36 for controlling the electron flow from backplate structure 30 to faceplate structure 32. Electrodes (likewise not shown) are typically also present along the edges of spacer walls 36 where they contact plate structures 30 and 32.

The sealing process of FIG. 2 is performed in the following manner starting with faceplate structure 32 in FIG. 2*a*. Part of the interior surface of structure 32 forms a rectangular annular sealing area 32S along which outer wall 34 is to be joined to structure 32. Faceplate sealing area 32S is indicated by dark line in FIG. 2. This, however, is only for illustrative purposes. Except as described in the following two paragraphs, structure 32 typically does not have a feature that expressly identifies the location of sealing area 32S. The rectangular shape of sealing area 32S can be seen in FIG. 3 which illustrates a layout view of structure 32 at the stage of FIG. 2*a*.

Figure 3:
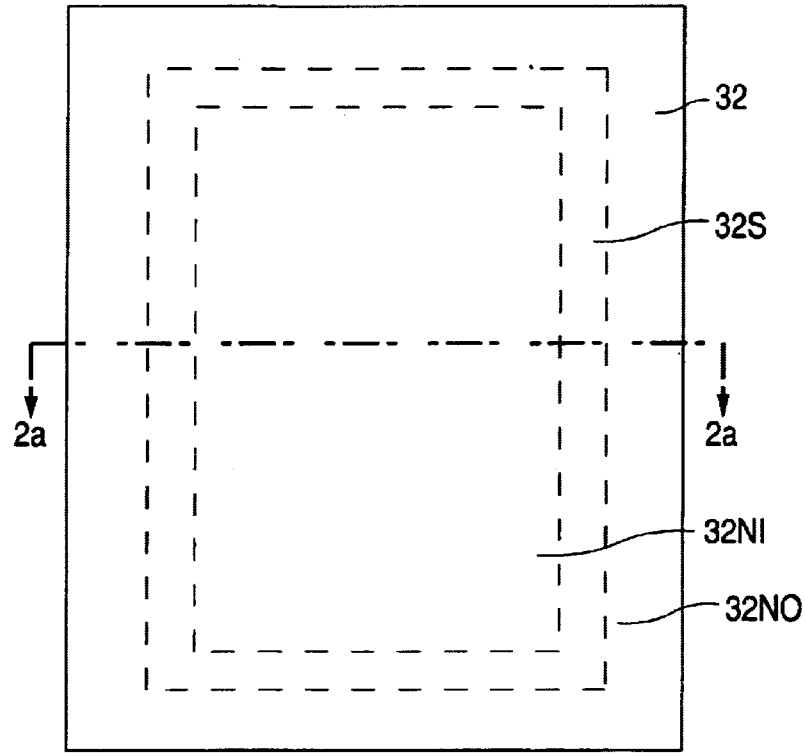
FIG. 3 is a layout view of the faceplate structure in FIG. 2*a*. The cross section of FIG. 2*a* is taken along plane 2*a*—2*a* in FIG. 3. The layout of FIG. 3 appears as viewed from plane 3—3 in FIG. 2*a*.

Faceplate sealing area 32S may be of different surface energy than the two portions, identified by reference symbols 32NI and 32NO in FIG. 3, of the interior surface of faceplate structure 32 adjoining and extending respectively along the inside and outside of sealing area 32S. If so, the surface energy of area 32S is of such a nature as to promote bonding of area 32S to the sealing material of outer wall 34. This generally means that area 32S is wettable by the wall sealing material. The surface energy of each of adjoining portions 32NI and 32NO is then of such a nature as to inhibit bonding of portions 32NI and 32NO to the sealing material of outer wall 34. This generally means that non-sealing portions 32NI and 32NO are largely non-wettable by the wall sealing material compared to area 325.

The surface energy difference between faceplate sealing area 32S and each of non-sealing portions 32NI and 32NO can be achieved in various ways. For example, area 32S or/and portions 32NI and 32NO can be treated with one or more appropriate chemical compounds that change the surface energy in the desired way. Material that yields the desired surface energy can be deposited to form area 32S or/and non-sealing portions 32NI and 32NO. In that case, area 32S may be visibly discernible. Examples of materials that can be deposited to provide area 32S with a different surface energy than non-sealing portions 32NI and 32NO are (a) carbon, (b) organic compounds such as polyimide, photoresist, hydrocarbons, and fluorinated plastics, and (c) electrical insulators such as aluminum oxide, silicon oxide, and silicon nitride.

Outer wall 34 is placed in an oven 38. See FIG. 2*b*. Wall 34 lies on a suitable support (not shown) in a horizontal position in oven 38. Faceplate structure 32 is placed in oven 38 and positioned on top of wall 34 with the interior surface of structure 32 facing downward so that sealing area 32S is vertically aligned to wall 34. The alignment is done with a suitable alignment system (not shown). Area 32S normally contacts wall 34 when the positioning step is completed.

After the alignment is completed, faceplate structure 32 is sealed to outer wall 34. The faceplate-structure-to-outer-wall seal can be done in any of a number of ways. Normally, the sealing of wall 34 to structure 32 is performed under non-vacuum conditions at a pressure close to room pressure (typically 1 atmosphere or 760 torr), usually in an environment of dry nitrogen or an inert gas such as argon. In a typical implementation, oven 38 is filled with dry nitrogen at a pressure of approximately 710 torr.

The faceplate-structure-to-outer-wall sealing operation typically entails appropriately heating outer wall 34 so as to cause wall 34 to soften. A thin portion of wall 34 along sealing area 32S may melt. When area 32S is of surface energy that promotes bonding of the sealing material of wall 34 to area 32S while adjoining portions 32NI and 32NO are of surface energy that inhibits bonding of the wall sealing material to portions 32NI and 32NO, portions 32NI and 32NO inhibit the sealing material of wall 34 from spreading laterally beyond area 32S.

Outer wall 34 is preferably sealed to faceplate structure 32 with a laser 40 after globally raising wall 34 and structure 32 to a bias temperature of 200–400° C., typically 340° C. The elevated temperature during the laser seal is employed to alleviate stress along the sealing interface and reduce the likelihood of cracking. Laser 40 produces a laser beam 42 which passes through a quartz window 38W located along the top of oven 38. Laser beam 42 passes through transparent material of faceplate structure 32 and impinges on outer wall 34 along sealing area 32S. Beam 42 normally makes one pass along the length of sealing area 32S. The light energy of beam 42 causes a thin portion of outer wall 34 along sealing area 32S to be raised up to, or above, the melting temperature of outer wall 34. The so-melted portion of wall 34 subsequently cools down to room temperature (typically 20–25° C.). During the cooldown, wall 34 becomes sealed to structure 32 along area 32S.

During the faceplate-structure-to-outer-wall sealing operation, faceplate structure 32 and outer wall 34 can have different orientations than that described above and shown in FIG. 2*b* where faceplate structure 32 is vertically on top of outer wall 34. For instance, wall 34 can be vertically on top of structure 32. In that case, laser 40 is typically situated vertically below oven 38.

The faceplate-structure-to-outer-wall seal can alternatively be effected in a sealing oven by globally raising faceplate structure 32 and outer wall 34 to a suitable sealing temperature to produce the seal and then cooling composite structure 32/34 down to room temperature. Structure 32 is typically oriented horizontally in the sealing oven with one of components 32 and 34 positioned vertically on top of the other of components 32 and 34. The faceplate-structure-to-outer-wall sealing temperature, typically in the vicinity of 300–600° C., equals or slightly exceeds the melting temperature of the frit in outer wall 34, and therefore causes the frit to be in a molten state for a brief period of time. The faceplate-structure-to-outer-wall sealing temperature is sufficiently low to avoid melting, or otherwise damaging, any part of faceplate structure 32.

After completing the faceplate-structure-to-outer-wall seal, resultant structure 32/34 is removed from oven 38 or other oven. Structure 32/34 is typically oriented so that outer wall 34 is vertically on top of faceplate structure 32, e.g., by flipping structure 32/34 over if faceplate structure 32 was vertically on top of outer wall 34 during the faceplate-structure-to-outer-wall sealing operation. See FIG. 2*c*.

Figure 4:
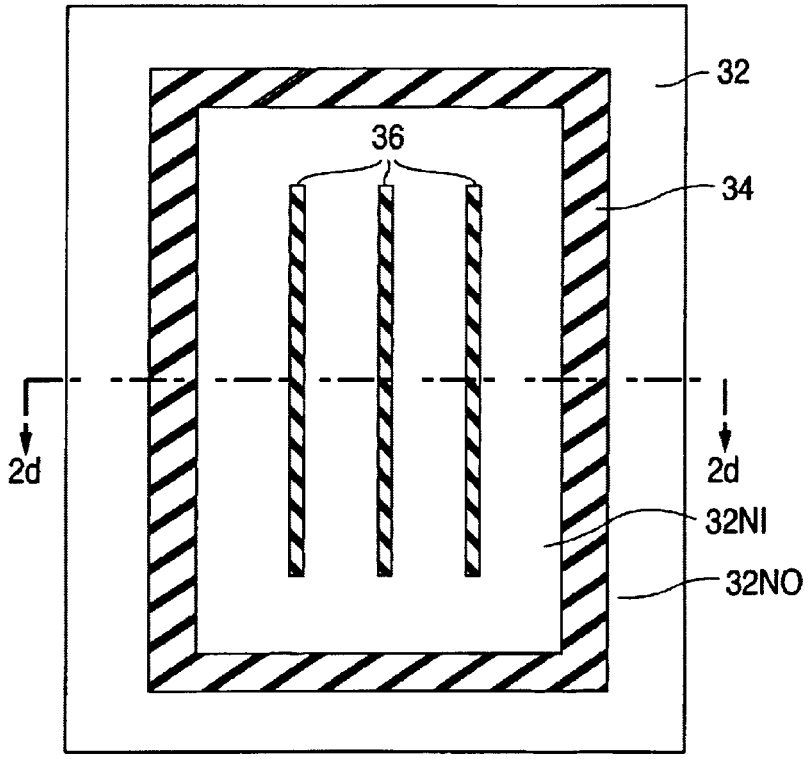
FIG. 4 is a cross-sectional layout view of the faceplate structure, outer wall, and spacer walls in FIG. 2*d*. The cross section of FIG. 2*d* is taken along plane 2*d*—2*d* in FIG. 4. The cross section of FIG. 4 is taken along plane 4—4 in FIG. 2*d*.

Spacer walls 36 are mounted on the interior surface of faceplate structure 32 inside outer wall 34. See FIG. 2*d*. Also see FIG. 4 which presents a plan view of resultant structure 32/34/36 at the stage of FIG. 2*d*. Spacer walls 36 are normally taller than outer wall 34. In particular, spacer walls 36 extend further away, typically an average of at least 50 $\mu$m further away, from faceplate structure 32 than does outer wall 34.

Although spacers walls 36 are normally mounted on faceplate structure 32 after the sealing of outer wall 34 to structure 32 is performed, spacer walls 36 can be mounted on structure 32 before the faceplate-structure-to-outer-wall seal. In that case, the faceplate-structure-to-outer-wall sealing temperature is sufficiently low to avoid melting, or otherwise damaging, walls 36.

Backplate structure 30 is to be hermetically sealed to outer wall 34 of structure 32/34/36 along a rectangular annular sealing area 30S of the interior surface of backplate structure 30. The rectangular shape of backplate sealing area 30S can be seen in FIG. 5 which presents a layout view of structure 30 prior to being joined to outer wall 34.

Figure 5:
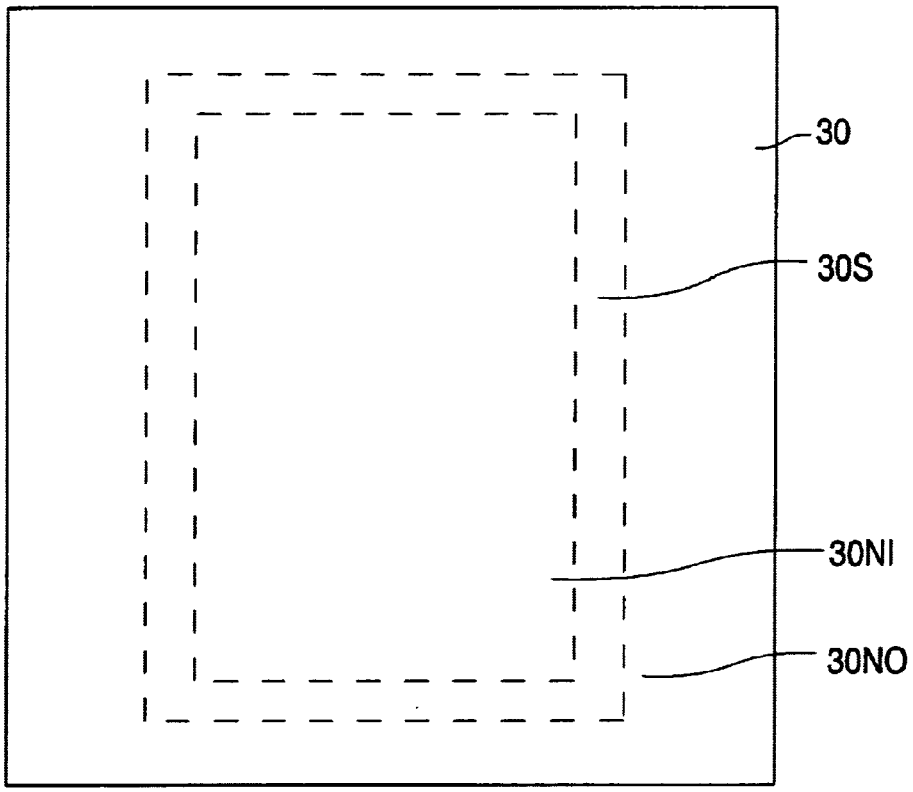
FIG. 5 is a layout view of the backplate structure as it appears before being brought into contact with the spacer walls and tacking structures in FIG. 2*f*.

Similar to what said above about faceplate sealing area 32S, backplate sealing area 30S may be of different surface energy than the two portions, indicated by reference symbols 30NI and 30NO in FIG. 5, of the interior surface of backplate structure 32 adjoining and extending respectively along the inside and outside of sealing area 30S. If so, the surface energy of area 30S is of such a nature as to promote bonding of area 30S to the corresponding sealing material of outer wall 34. This generally means that area 30S is wettable by the wall sealing material. The surface energy of each of adjoining backplate area portions 30NI and 30NO is then of such a nature as to inhibit bonding of portions 30NI and 30NO to the sealing material of outer wall 34. Non-sealing area portions 30NI and 30NO are thus largely non-wettable by the wall sealing material compared to area 30S.

The surface energy difference between backplate sealing area 30S and each of non-sealing portions 30NI and 30NO can be attained in various ways. For instance, area 30S or/and portions 30NI and 30NO can be chemically treated so as to change the surface energy in the desired way. Material that yields the desired surface energy can be deposited to form area 30S or/and portions 30NI and 30NO. The above-mentioned carbon-containing materials and electrical insulators suitable for deposition to provide faceplate sealing area 32S with a different surface energy than faceplate non-sealing portions 32NI and 32NO can also be deposited to provide backplate sealing area 30S with a different surface energy than backplate non-sealing portions 30NI and 30NO.

A getter (not shown) may be situated either on the interior surface of backplate structure 30 within sealing area 30S or on the interior surface of faceplate structure 32 within sealing area 32S and thus within outer wall 34 at this point in the sealing process. As a result, the getter is located within the enclosure formed when backplate structure 30 is sealed to composite structure 32/34/36. A pump-out tube (not shown) for evacuating the display is normally connected to the display, typically to backplate structure 30. Alternatively, the getter may be partially or wholly situated in the pump-out tube.

As another alternative, the getter may be situated in a thin auxiliary compartment (not shown) later mounted over the exterior surface of the backplate and accessible to the enclosed region between plate structures 30 and 32 by way of one or more openings in the backplate and/or, depending on the configuration of the auxiliary compartment, one or more openings in outer wall 34. In this case, the auxiliary compartment does not extend significantly above circuitry mounted over the exterior surface of the backplate for controlling display operation, and thus does not create any significant difficulties in handing the flat-panel display. When the getter is situated in such an auxiliary compartment, the pump-out tube is typically connected to the auxiliary compartment. Part of the getter may be situated in the pump-out tube.

The getter sorbs (collects) contaminant gases produced during, and subsequent to, the sealing of backplate structure 30 to composite structure 32/34/36, including contaminant gases produced during operation of the hermetically sealed flat-panel display. The getter may consist of non-evaporable or/and evaporable gettering material. Techniques for activating non-evaporable getter material are described in U.S. Pat. No. 5,977,706, the contents of which are incorporated by reference herein.

Backplate structure 30 is now brought into contact with composite structure 32/34/36 in such a way that the interior surface of backplate structure 30 meets spacer walls 36 with backplate sealing area 30S aligned to outer wall 34. Because spacer walls 36 extend further away from faceplate structure 32 than does outer wall 34, a gap separates outer wall 34 from backplate structure 30 along all, or largely all, of area 30S.

In the course of aligning backplate structure 30 to composite structure 32/34/36, a tacking operation is normally performed to hold backplate structure 30 in a fixed positional relationship to faceplate structure 32 and thus in a fixed positional relationship to structure 32/34/36. The tacking operation broadly entails rigidly coupling plate structures 30 and 32 together through a suitable intermediate mechanism at multiple locations spaced laterally apart along structures 30 and 32. The alignment and tacking operations can be done in various ways. FIGS. 2*e* and 2*f* illustrate one way for implementing the alignment and tacking operations.

In the example of FIGS. 2*e* and 2*f*, faceplate structure 32 initially extends roughly horizontal with its interior surface pointing upward. See FIG. 2*e*. A tacking system consisting of a group of laterally separated tack structures 44 is provided on the interior surface of faceplate structure 32 outside outer wall 34. Each tack structure 44 consists of a main tack body 44M and a pair of bonding pieces 44F and 44B provided respectively on the bottom and top surfaces of main tack body 44M. Bonding pieces 44F and 44B typically consist of suitable glue or other adhesive. For instance, bonding pieces 44F and 44B may consist of glue that cures when appropriately subjected to ultraviolet ("UV") light or heat provided, e.g., by visible or/and infrared ("IR") light. Piece 44F of each tack structure 44 is situated between the interior surface of faceplate structure 32 and tack body 44M for that tack structure 44. Tack structures 44 typically extend approximately the same distance away from, i.e., above in the example of FIG. 2*e*, faceplate structure 32 as do spacer walls 36.

Backplate structure 30 is placed on top of composite structure 32/34/36 with the interior surface of backplate structure 30 facing downward so that sealing area 30S is vertically aligned to outer wall 34. See FIG. 2*f*. The alignment is done with a suitable alignment system (not shown). In addition to contacting spacer walls 36, the interior surface of structure 30 contacts bonding pieces 44B of tack structures 44. The alignment is normally done optically in a non-vacuum environment, normally at room pressure, with alignment marks provided on plate structures 30 and 32. Specifically, backplate structure 30 is optically aligned to faceplate structure 32.

In aligning backplate structure 30 to composite structure 32/34/36, various techniques may be employed to ensure that spacer walls 36 stay in fixed locations relative to backplate structure 30. For example, walls 36 may go into shallow grooves (not shown) provided along the interior surface of structure 30. The grooves may extend below the general plane of the interior surface of structure 30 or may be provided in structures extending above the general plane of the interior surface of structure 30. Walls 36 may have feet attached to structure 30.

FIG. 2*f* presents an example in which bonding pieces 44F and 44B consist of adhesive, such as UV-curable or thermally curable glue, that provides strong bonding upon being subjected to suitable radiation. For this purpose, composite structure 32/34/36, including tack structures 44, lies between a pair of lasers 46 and 48 in the alignment system. Laser 46 overlies structure 32/34/36. Laser 48 underlies structure 32/34/36. Lasers 46 and 48 respectively provide laser beams 50 and 52 which respectively impinge downward and upward on structure 32/34/36 at the locations for tack structures 44. When bonding pieces 44F and 44B consist of UV-curable glue, laser beams 50 and 52 consist of light at one or more appropriate UV wavelengths. Similarly, laser beams 50 and 52 consist of visible or/and IR light when pieces 44F and 44B are formed with thermally curable glue.

Backplate structure 30 is transparent, or largely transparent, to light (including UV and/or IR light) at the locations above tack structures 44. To the extent that structure 30 may have opaque regions, e.g., metallic electrodes, directly above tack structures 44, these opaque regions are sufficiently narrow that they do not significantly affect the passage of light through structure 30. Accordingly, laser beams 50 and 52 respectively pass through transparent material of plate structures 30 and 32 and impinge respectively on bonding pieces 44B and 44F, curing them so that they chemically and/or physically interact with structures 30 and 32. As a result, pieces 44B and 44F securely join tack structures 44 to plate structures 30 and 32. Tack structures 44 then cooperate with spacer walls 36 in causing plate structures 30 and 32 to be spaced apart from each other in a largely fixed manner. Lasers 46 and 48 can be replaced with focused lamps that provide appropriate light for curing pieces 44B and 44F.

Rather than using tack structures 44 to tack backplate structure 30 to faceplate structure 32 and thus to composite structure 32/34/36, the tacking operation can be performed by joining backplate structure 30 to faceplate structure 32 along outer wall 34 at multiple laterally separated tacking seal portions of backplate sealing area 30S. This is typically performed by directing light energy of a laser or focused lamp through the tacking seal portions of area 30S and onto the corresponding adjacent portions of wall 34. Thin portions of wall 34 melt when struck by the beam of light energy. Upon cooling, the thin portions of wall 34 then securely hold backplate structure 30 in a fixed position relative to faceplate structure 32.

As another alternative, faceplate structure 32 can be tacked to backplate structure 30 through selected ones or all of spacer walls 36. Each wall 36 intended to serve as a tack element for tacking structure 32 to structure 30 is referred to here as a tacking spacer wall. Each tacking spacer wall 36 is connected to faceplate structure 32 during the tacking operation or at an earlier point, e.g., during the placement of walls 36 on the interior surface of structure 32 at the stage of FIG. 2*d*. During the tacking operation, each tacking spacer wall 36 is rigidly connected to the interior surface of backplate structure 30.

The rigid connection of tacking spacer walls 36 to plate structures 30 and 32 can be performed in various ways. For example, plate structure 30 or/and plate structure 32 can be provided with one or more grippers into which each tacking spacer wall 36 is inserted. The grippers securely physically clamp tacking spacer walls 36 to structure 30 or/and structure 32 so as to hold faceplate structure 32 in a fixed positional relationship to backplate structure 30.

Glue or other adhesive can be utilized to rigidly connect each tacking spacer wall 36 to backplate structure 30 or/and faceplate structure 32. The adhesive can be placed on opposite top and bottom edges of each tacking spacer wall 36 or/and on suitable portions of structure 30 or/and structure 32 prior to rigidly connecting tacking spacer walls 36 to structure 30 or/and structure 32. When the adhesive needs UV or thermal curing to create the rigid bonds, an appropriate curing step is performed, e.g., globally in a heating oven for thermal curing or locally with one or two lasers or focused lamps for thermal or UV curing. When used, the laser or lasers can be arranged generally in the manner depicted in FIG. 2*f* for lasers 46 and 48.

Tacking spacer walls 36 can be rigidly connected to backplate structure 30 or/and faceplate structure 32 by metal such as suitable eutectic, solder, or braze. Heat is applied in an appropriate manner to form each eutectic, solder, or braze bond. Tacking spacer walls 36 can also be ultrasonically bonded to structure 30 or/and structure 32. One of the preceding tacking techniques can be employed to connect tacking spacer walls 36 to backplate structure 30 during the tacking operation while another of these techniques is used to connect tacking spacer walls 36 to faceplate structure 32 during or before the tacking operation.

Tacked, aligned structure 30/32/34/36, typically including tack structures 44, is oriented so that faceplate structure 32 is vertically on top as shown in FIG. 2*g*, e.g., by flipping structure 30/32/34/36 over if backplate structure 30 was previously vertically on top, and placed in a sealing oven 54 for sealing backplate structure 30 to outer wall 34. See FIG. 2*h*. As situated in oven 54, backplate structure 30 is thereby positioned vertically below faceplate structure 32 such that spacer walls 36 and the sealing material formed with outer wall 34 lie between plate structures 30 and 32. Tacked structure 30/32/34/36 normally extends approximately horizontal, i.e., a normal to the exterior surface of plate structure 30 or 32 extends approximately in the vertical direction. Tacked structure 30/32/34/36 can, however, extend somewhat off-horizontal, typically up to at least 20° off-horizontal, without significantly affecting the backplate-structure-to-outer-wall seal.

Faceplate structure 32 and outer wall 34 are vertically separated from backplate structure 30 either along all of backplate sealing area 30S or, in the case where backplate structure 30 is directly tacked to outer wall 34, along largely all of area 30S. Spacer walls 36 and, when present, tack structures 44 form an intermediate system which is situated between plate structures 30.and 32 and which causes structures 30 and 32 to be spaced vertically apart from each other in a largely fixed manner. As composite structure 30/32/34/36 is oriented in oven 54, the gap between backplate structure 30 and outer wall 34 runs along the then-existent bottom edge of wall 34.

The sealing of outer wall 34 to backplate structure 30 in oven 54 can be performed in any of a number of ways after composite structure 30/32/34/36, again typically including tack structures 44, is arranged in the foregoing manner. The backplate-structure-to-outer-wall sealing operation is normally done under non-vacuum conditions at a pressure close to room pressure, typically in an environment of dry nitrogen or an inert gas such as argon. In a typical implementation, oven 54 is filled with dry nitrogen at a pressure of approximately 710 torr. Alternatively, the backplate-structure-to-outer-wall sealing operation can be performed at a suitably high vacuum, typically a pressure of $10^{-6}$ torr or less, in a sufficiently large vacuum chamber. In that event, the flat-final display is normally not provided with a pump-out tube for evacuating the display.

A heating operation, referred to as the gravitational heating operation, is performed to cause the sealing material formed with outer wall 34 to soften and move vertically downward under gravitational influence so as to contact backplate structure 30 and seal plate structures 30 and 32 together through outer wall 34. In particular, the temperature of wall 34 is raised sufficiently that the sealing material of wall 34 softens and moves slowly downward to meet structure 30 during the gravitational heating operation. Wall 34 is then cooled down. During the cooldown, wall 34 becomes hermetically sealed to structure 30 along all of backplate sealing area 30S.

The intermediate system formed with spacer walls 36 and, when present, tack structures 44 causes plate structures 30 and 32 to remain vertically spaced apart from each other during the gravitational heating operation in largely the fixed manner established directly before the gravitational heating operation. Specifically, the distance between plate structures 30 and 32 along any vertical line through structures 30 and 32 remains largely constant during the gravitational heating operation. Consequently, largely no z motion occurs between structures 30 and 32 during the gravitational heating operation, thereby substantially avoiding alignment degradation that might otherwise arise as a consequence of such z motion.

Also, the tack system formed with tack structures 44, with the regions where outer wall 34 is directly tacked to backplate structure 30, or with spacer walls 36 to the extent that they are used as tacking elements largely prevents plate structures 30 and 32 from moving horizontally relative to each other during the gravitational heating operation. The net result is that structures 30 and 32 remain in a largely fixed positional relationship to each other during the gravitational heating operation. When backplate sealing area 30S is of surface energy that promotes bonding of outer wall 34 to area 30S while adjoining backplate area portions 30NI and 30NO are of surface energy that inhibits bonding of wall 34 to portions 30NI and 30NO, non-sealing portions 30NI and 30NO inhibit the sealing material of outer wall 34 from spreading laterally beyond area 30S.

The gravitational heating operation preferably consists of globally heating structures 30 and 32/34/36, typically including tack structures 44, by raising structures 30 and 32/34/36 to a sealing temperature of 300–600° C., preferably 320–500°, typically 450° C., for 15–30 min., typically 20 min. For instance, the oven temperature can be ramped upward from room temperature to 450° C. at 5° C./min., maintained at 450° C. for 20 min., and then ramped downward from 450° C. to room temperature at −5° C./min. Although the sealing temperature is high enough to cause the sealing material of outer wall 34 to soften and, in some cases, melt or be on the verge of melting, the sealing temperature is sufficiently low to avoid significantly damaging any critical component of structure 30 or 32 or any of spacer walls 36.

Alternatively, the gravitational heating operation can be performed by locally heating outer wall 34 to a temperature high enough to cause the sealing material of wall 34 to soften and move downward to contact backplate structure 30. The local heating entails directing a beam of energy onto wall 34. The energy beam can be highly focused as occurs with light energy provided from a laser or focused lamp. The energy beam can also be less focused than occurs with a laser or focused lamp provided that the heat energy does not go significantly beyond wall 34. As an example, wave energy in the form of microwave or IR radiation can be utilized to locally heat wall 34.

As a further alternative, global heating of structures 30 and 32/34/36 can be combined with local heating of outer wall 34. In particular, the temperature of oven 54 can be raised to a point somewhat below that needed to cause the sealing material of wall 34 to soften and move significantly downward under gravitational influence. Local heating, e.g., by a laser or focused lamp, is then performed on wall 34 to raise its temperature to a point sufficiently high that the sealing material of wall 34 softens and moves downward under gravitational influence to meet backplate structure 30 and, upon cooldown, becomes hermetically sealed to structure 30.

After the gravitational heating operation is completed, sealed structure 30/32/34/36, typically including tack structures 44, is removed from oven 54. FIG. **2*i* illustrates how the sealed flat-panel display appears at this stage. The sealing material formed with outer wall 34 does not extend significantly beyond sealing area 30S of backplate structure 30. Also, the wall sealing material extends continuously from faceplate structure 32 to backplate structure 30**.

Tack structures 44, when present, typically remain in the final flat-panel display but can be removed from the display. In any event, subsequent operations depend (in part) on whether the gravitational heating operation was performed under vacuum or non-vacuum conditions. If the gravitational heating operation was conducted under non-vacuum conditions, subsequent operations entail evacuating the interior of the sealed display to a pressure of $10^{-6}$ torr or less, closing the pump-out tube (again, not shown), and activating the getter (again, likewise not shown) to the extent that the getter consists of non-evaporable getter material.

Subject to being in an activated condition after the flat-panel display is evacuated, activation of the getter can be performed before, during, and/or after closure of the pump-out tube. Various techniques, including global heating of the display and local heating of the getter by, e.g., a laser or focused lamp, can be employed to activate the getter. When the getter is situated in an auxiliary compartment attached to backplate structure 30, the auxiliary compartment is normally sealed to structure 30 subsequent to sealing outer wall 34 to structure 30 but before activating the getter and closing the pump-out tube. Nonetheless, the auxiliary compartment can be sealed to structure 30 at the same time that composite structure 32/34/36 is sealed to structure 30 and thus during the gravitational heating operation.

If the gravitational heating operation was done under vacuum conditions, the subsequent operations primarily entail activating the getter. If the getter is partially or wholly situated in an auxiliary compartment, the auxiliary compartment is sealed to backplate structure 30 either during the gravitational heating operation or after the gravitational heating operation and thus under vacuum conditions. Inasmuch as no pump-out tube is normally employed when the gravitational heating operation is done under vacuum conditions, the flat-panel display is fully sealed at the end of the gravitational heating operation or, as appropriate, after sealing the auxiliary compartment to backplate structure 30 under vacuum conditions. The interior of the sealed display is at a pressure suitably low for display operation.

Figure 6:
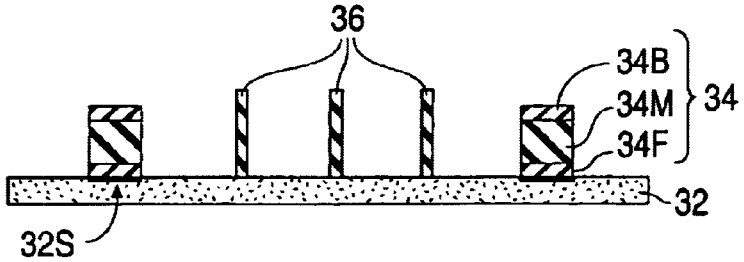
FIG. 6 is a cross-sectional side view of a variation of the faceplate structure, outer wall, and spacer walls in FIG. 2*d*.

Rather than consisting totally of sealing material that softens and moves downward during the gravitational heating operation, outer wall 34 may consist only partly of such sealing material. FIG. 6 illustrates a structure containing such a variation of wall 34 at the stage of FIG. **2*d*. In this variation, wall 34 consists of a main outer wall portion 34M and a pair of sealing portions 34B and 34F. Sealing portion 34B is situated on one edge of main wall portion 34M. Sealing portion 34F is situated on the opposite edge of main wall portion 34M. At the point shown in FIG. 6, sealing portion 34F joins main portion 34M, and thus outer wall 34, to faceplate structure 32**.

Sealing portions 34B and 34F, typically consisting of frit, soften and move vertically downward during the gravitational heating operation in which outer wall 34 is sealed to backplate structure 30. Main wall portion 34M consists of material, such as ceramic, which does not significantly change shape when subjected to the temperature that sealing portions 34B and 34F are subjected to during the gravitational heating operation. Although main portion 34M typically moves downward during the gravitational heating operation due to the downward movement of sealing portion 34F, main portion 34M does not soften significantly during the gravitational heating operation and thus does not significantly change shape.

Seal-restricting Structures

The process of FIG. 2 is particularly suitable for sealing a flat-panel display when there is only a relatively small change in viscosity of the sealing material during heating steps, especially the gravitational heating operation utilized to seal backplate structure 30 to outer wall 34. However, it is sometimes desirable to utilize sealing material that undergoes a relatively large viscosity change during heating steps. In such cases, one or more seal-restricting structures can be utilized in place of, or in addition to, surface-energy modification to inhibit the sealing material of wall 34 from spreading laterally during elevated-temperature operations such as the gravitational heating operation.

FIGS. 7*a*–7*d* (collectively "FIG. 7") illustrate part of a general process for hermetically sealing a flat-panel display utilizing seal-restricting structures in accordance with the invention. The process of FIG. 7 begins with the steps of FIGS. 2*a*–2*e* for creating composite structure 32/34/36, including tack structures 44, as described above. The steps of FIGS. 7*a*–7*d* respectively parallel the steps of FIGS. 2*f*–2*i*.

A pair of concentric rectangular annular seal-restricting structures 60 and 62 are provided on the interior surface of backplate structure 30. The combination of backplate structure 30 and backplate restricting structures 60 and 62 forms a composite backplate structure 30/60/62. The rectangular shape of restricting structures 60 and 62 can be seen in FIG. 8 which presents a layout view of composite backplate structure 30/60/62 prior to being joined to outer wall 34 according to the process of FIG. 7. As described further below, restricting structures 60 and 62 are positioned in such a way on backplate structure 30 that, in the sealed flat-panel display, inner restricting structure 60 runs along the inside of wall 34 while outer restricting structure 62 runs along the outside of wall 34. Backplate sealing area 30S extends between structures 60 and 62.

Backplate restricting structures 60 and 62 normally (but not necessarily) consist of material largely non-wettable by the sealing material of outer wall 34 relative to sealing area 30S of backplate structure 30. When wall 34 consists of frit, at least along area 32S, restricting structures 60 and 62 typically consist of carbon-containing material, especially hydrocarbon material. One example is polyimide. Another is silicon carbide. Structures 60 and 62 may consist of material, such as silicon nitride, which does not contain a significant amount of carbon. Structures 60 and 62 normally have a width (or thickness) measured laterally of 0.2–2 mm, typically 0.5 mm.

Backplate restricting structures 60 and 62 can be formed in various ways. For instance, at a suitable stage during the manufacture of composite backplate structure 30/60/62, a blanket layer of the seal-restricting material can be formed on the then-existent interior surface of backplate structure 30. The formation of the blanket layer can be done by a deposition technique such as evaporation, sputtering, liquid spraying, spin coating, meniscus coating, extrusion coating, or chemical vapor deposition. A deposited amount of the seal-restricting material can be spread with a doctor blade. Using a suitable photoresist mask, undesired portions of seal-restricting material are removed to produce restricting structures 60 and 62.

Alternatively, backplate restricting structures 60 and 62 can be selectively deposited, typically by evaporation or sputtering, on the then-existent interior surface of backplate structure 30 using a shadow mask to prevent the seal-restricting material from accumulating on undesired portions of the then-existent interior surface of backplate structure 30. Instead of a shadow mask, a photoresist mask can be formed on portions of the then-existent surface of backplate structure 30 not intended to receive the seal-restricting material. The seal-restricting material is then deposited, typically by any of the techniques mentioned above for depositing a blanket layer of the seal-restricting material, after which the photoresist mask is removed to remove any seal-restricting material accumulated on the mask. Restricting structure 60 and 62 can also be screen printed on the then-existent interior surface of backplate structure 30 using a liquid or slurry that contains the seal-restricting material.

Backplate restricting structures 60 and 62 can be created from actinic material by depositing a layer of actinic seal-restricting material on the then-existent interior surface of backplate structure 30, exposing part of the material to suitable actinic radiation, and removing either the exposed or unexposed actinic material with a suitable developer. When the actinic material consists of photopolymerizable material such as photopolymerizable precursor polyimide material, the actinic radiation is typically UV light that causes the exposed photopolymerizable material to polymerize. The unexposed photopolymerizable material is then removed with the developer.

Figure 7A:
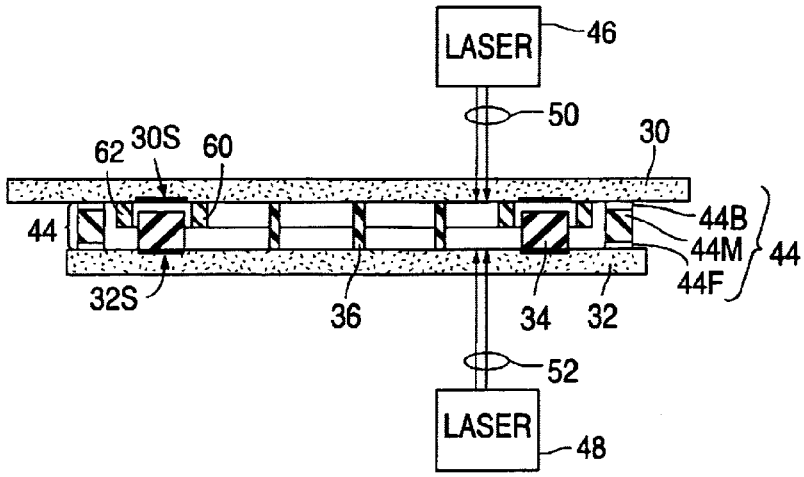
FIGS. 7*a*–7*d* are cross-sectional side views representing steps in part of a process for sealing a flat-panel display utilizing seal-restricting structures according to the invention. The process of FIGS. 7*a*–7*d* begins with the steps of FIGS. 2*a*–2*e*.

With composite backplate structure 30/60/62 having been formed in the preceding way, structure 30/60/62 is placed on top of composite structure 32/34/36 as shown in FIG. 7*a*. In particular, structure 30/60/62 is positioned over structure 32/34/36 in the same way that backplate structure 30 is positioned over structure 32/34/36 at the corresponding stage shown in FIG. 2*f* for the process of FIG. 2. Consequently, the interior surface of backplate structure 30 in composite structure 30/60/62 faces downward with backplate sealing area 30S vertically aligned to outer wall 34. The interior surface of backplate structure 30 contacts spacer walls 36 and bonding pieces 44B of tack structures 44. Since spacer walls 36 are taller than outer wall 34, a gap is again present between backplate structure 30 and outer wall 34 along all, or largely all, of area 30S. The alignment is performed in the way described above in connection with FIG. 2*f*.

Outer wall 34 is situated opposite backplate sealing area 30S and therefore opposite a location between backplate restricting structures 60 and 62. Wall 34 may, or may not, extend into the space between structures 60 and 62. Wall 34 typically does not contact structure 60 or 62 at the stage of FIG. 7*a*. The lateral spacing between wall 34 and structure 60 or 62 is normally 5–500 $\mu$m, typically 250 $\mu$m. However, wall 34 can contact structure 60 or/and structure 62 at this point. In any event, structures 60 and 62 are shorter than spacer walls 36 and thus do not contact faceplate structure 32.

Only one of restricting structures 60 and 62 may actually be provided on backplate structure 30. In that case, outer wall 34 is situated at a location close to that one of structures 60 and 62 at the stage of FIG. 7*a*. As in the case where both of structures 60 and 62 are present, the lateral spacing between wall 34 and structure 60 or 62 present on backplate structure 30 is normally 5–500 $\mu$m, typically 250 $\mu$m, but can drop to zero. If only one of restricting structures 60 and 62 is present, that one is typically inner structure 60. Except as specifically indicated below, the remainder of the description of the process of FIG. 7 is presented below as if backplate structure 30 were provided with both of restricting structures 60 and 62. To the extent that one of structures 60 and 62 may be absent, a reference to, e.g., a reference symbol denoting, an absent one of structures 60 and 62 is to be ignored in the remainder of the process description of FIG. 7. For instance, a reference to composite backplate structure 30/60/62 thereby means composite backplate structure 30/60 if outer restricting structure 62 is absent or composite backplate structure 30/62 if inner restricting structure 60 is absent.

Composite backplate structure 30/60/62 is typically tacked to composite structure 32/34/36 using lasers 46 and 48 in the same way that lasers 46 and 48 are employed to tack backplate structure 30 to composite structure 32/34/36 in the process of FIG. 2 at the stage of FIG. 2*f*. As indicated in FIG. 7*a*, laser beams 50 and 52 respectively impinge downward and upward on structure 32/34/36 at the locations of tack structures 44. Bonding pieces 44B and 44F are cured by laser beams 50 and 52 so as to chemically or/and physically interact with plate structures 30 and 32. Focused lamps can be substituted for lasers 46 and 48. In any event, bonding pieces 44B and 44F tack structures 44 to plate structures 30 and 32. Once again, tack structures 44 cooperate with spacer walls 36 in causing plates structures 30 and 32 to be spaced vertically apart from each other in a largely fixed manner.

Similar to what was said above about the alternative ways of tacking backplate structure 30 to faceplate structure 32 in the process of FIG. 2, composite backplate structure 30/60/62 in the process of FIG. 7 can alternatively be tacked to structure 32 at multiple laterally separated tacking seal portions of backplate sealing area 30S rather than being tacked to structure 32 by way of tack structures 44. This alternative tacking procedure is typically implemented by directing light energy of a laser or a focused lamp through the tacking seal portions of area 30S and onto adjacent portions of outer wall 34 in the way described above for the process of FIG. 2. Wall 34 is thereby joined to backplate structure 30 at multiple locations spaced laterally apart along area 30S.

Composite backplate structure 30/60/62 can also be tacked to faceplate structure 32 along selected ones or all of spacer walls 36. Except for backplate structure 30/60/62 in the process of FIG. 7 replacing backplate structure 30 in the process of FIG. 2, this alternative is performed in the way described above for tacking backplate structure 30 to faceplate structure 32 through selected ones or all of spacer walls 36 in the process of FIG. 2.

Figure 7B:
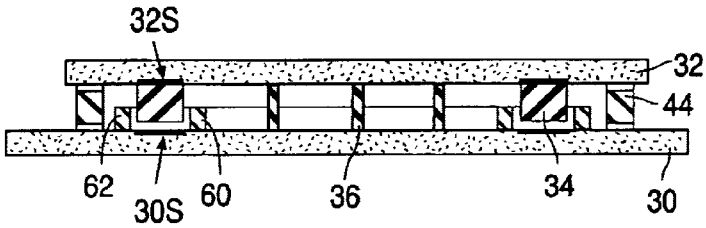
Figure 7C:
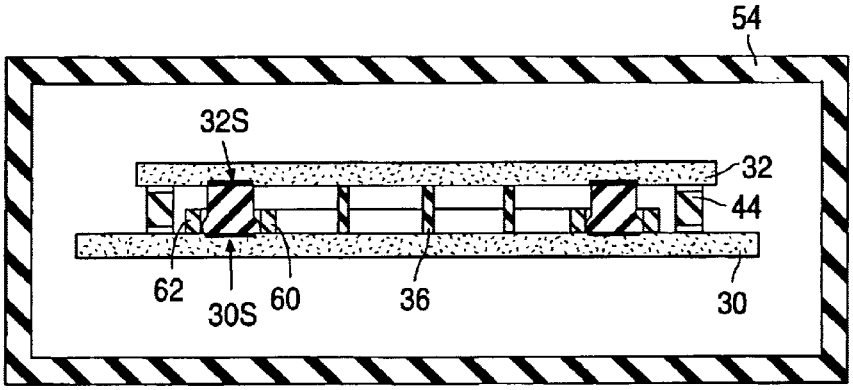

Tacked, aligned structure 30/32/34/36/60/62, typically including tack structures 44, is oriented so that faceplate structure 32 is on top, typically by flipping structure 30/32/34/36/60/62 over as indicated in FIG. 7*b*, and placed in oven 54. See FIG. 7*c*. As occurs at the corresponding stage of FIG. 2*h* in the process in FIG. 2, backplate structure 30 is positioned vertically below faceplate structure 32 in oven 54 at the stage of FIG. 7*c* with outer wall 34 lying between plate structures 30 and 32. Spacer walls 36 and, when present, tack structures 44 again form an intermediate mechanism situated between plate structures 30 and 32 for causing structures 30 and 32 to be spaced vertically apart from each other in a largely fixed manner.

Outer wall 34 is now sealed to backplate structure 30 in the manner described above in connection with the process of FIG. 2 at the stage of FIG. 2*h*. Oven 54 is normally filled with dry nitrogen or/and an inert gas at a pressure close to room pressure. Alternatively, oven 54 can be a vacuum chamber that is pumped down to a high vacuum condition, typically a pressure of $10^{-6}$ torr or less, after tacked structure 30/32/34/36/60/62 is placed in over 54.

A heating operation is performed to cause the sealing material formed with wall 34 to soften and move vertically downward under gravitational influence. During this heating operation, again referred to as the gravitational heating operation, the wall sealing material contacts backplate structure 30 along backplate sealing area 30S. Plate structures 30 and 32 are thereby sealed together through wall 34.

The intermediate structure formed with spacer walls 36 and, when present, tack structures 44 again causes plate structures 30 and 32 to remain spaced vertically apart from each other in largely the fixed manner established directly before the gravitational heating operation. The tack system prevents structures 30 and 32 from moving horizontally relative to each other. Hence, structures 30 and 32 remain in largely a fixed position relative to each other during the gravitational heating operation. Because there is largely no z motion between structures 30 and 32 during the gravitational heating operation, alignment degradation due to such z motion is again avoided.

During the gravitational heating operation, the sealing material of outer wall 34 contacts backplate structure 30 between restricting structures 60 and 62. Depending on the viscosity of the sealing material and on the lateral separation between wall 34 and each of restricting structures 60 and 62 prior to the gravitational heating operation, wall 34 may contact the outer sidewall of inner restricting structure 60 and/or the inner sidewall of outer restricting structure 62. However, structures 60 and 62 largely prevent the wall sealing material from spreading over structures 60 and 62 and contacting backplate structure 30 laterally beyond structures 60 and 62. That is, inner restricting structure 60 largely prevents the wall sealing material from contacting backplate structure 30 inside inner structure 60 and damaging sensitive elements such as electron-emissive elements in the active portion of backplate structure 30. Outer restricting structure 62 similarly largely prevents the wall sealing material from contacting backplate structure 30 outside structure outer 62. The capability to achieve such restriction is typically enhanced by manufacturing restricting structures 60 and 62 so as to be largely non-wettable by the wall sealing material.

By appropriately choosing the lateral spacing between wall 34 and each of backplate restricting structures 60 and 62 prior to the gravitational heating operation, the sealing material of outer wall 34 normally does not spread laterally to contact inner structure 60 beyond its outer sidewall or to contact outer structure 62 beyond its inner sidewall. That is, the wall sealing material normally does not extend significantly over the top of structure 60 or 62. Because structures 60 or 62 provide physical and/or chemical restraints to the lateral spreading of the wall sealing material during the gravitational heating step, the viscosity of outer wall 34 in the process of FIG. 7 can change more during the gravitational heating operation than in the process of FIG. 2.

When only one of restricting structures 60 and 62 is provided on backplate structure 30, outer wall 34 contacts backplate structure 30 close to that one of structures 60 and 62 during the gravitational heating operation. For example, if inner structure 60 is present but outer structure 62 is absent, wall 34 contacts backplate structure 30 close to the outer sidewall of inner structure 60. On the other hand, if outer structure 62 is present but inner structure 60 is absent, wall 34 contacts backplate structure 30 close to the inner sidewall of structure 62.

Figure 7D:
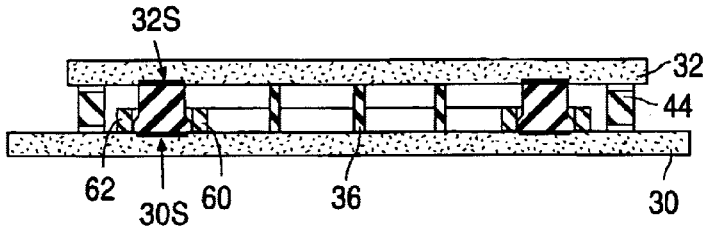
Figure 8:
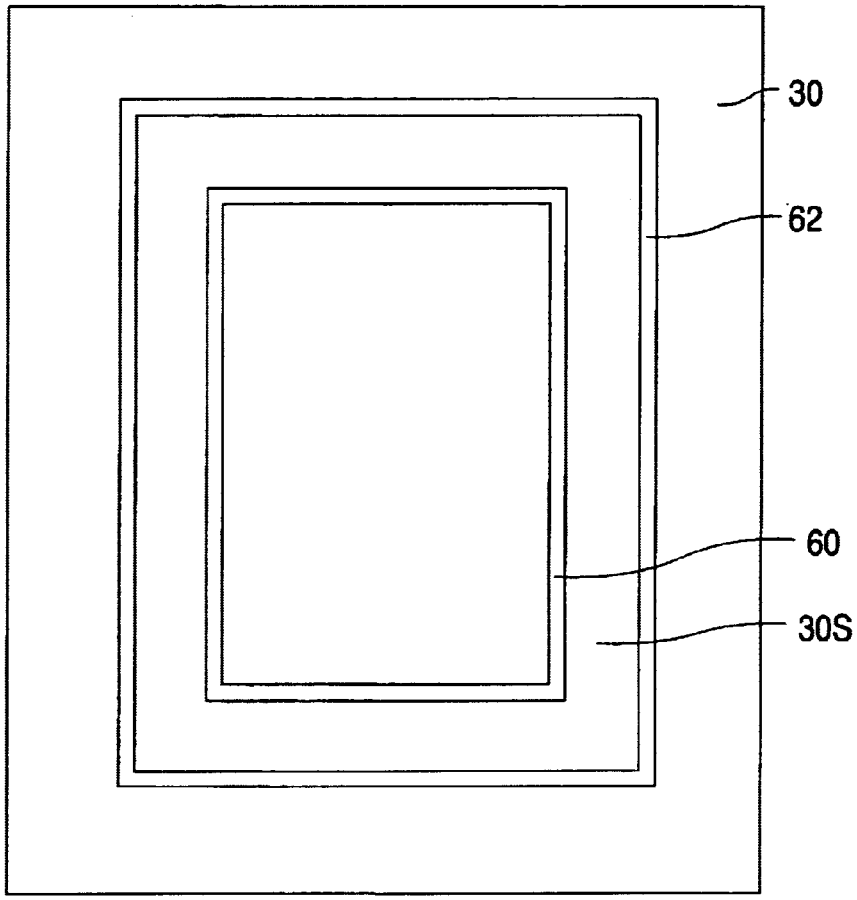
FIG. 8 is a layout view of the backplate structure as it appears before being brought into contact with the spacer walls and tacking structures in FIG. 7*a*.

Additionally, when only one of restricting structures 60 and 62 is present, backplate sealing area 30S may be of different surface energy than the portion 30NI or 30NO of the interior surface of backplate structure 30 extending along and adjoining area 30S and situated on the opposite side of area 30S from that one of structures 60 and 62. For instance, if only inner structure 60 is present, area 30S may be of different surface energy than portion 30NO extending along the outside of area 30S. If only outer structure 62 is present, area 30S may be of different surface energy than portion 30NI extending along the inside of area 30S. Although neither of backplate area portions 30NI and 30NO is indicated in FIG. 7 or 8, the locations of portions 30NI and 30NO are indicated in FIG. 5 which presents a layout view corresponding to that of FIG. 8 but prior to the formation of restricting structures 60 and 62 on backplate structure 30. Accordingly, FIG. 5 effectively presents a layout view of backplate structure 30 for the process of FIG. 7 prior to forming restricting structures 60 and 62.

The surface energy of backplate sealing area 30S promotes bonding of the sealing material of outer wall 34 to area 30S. During the gravitational heating operation, the wall sealing material wets area 30S. When backplate area portion 30NI or 30NO is of different surface energy than area 30S, the surface energy of portion 30NI or 30NO is chosen to inhibit bonding of the wall sealing material to portion 30NI or 30NO. During the gravitational heating operation, the wall sealing material does not significantly wet portion 30NI or 30NO compared to how the sealing material wets area 30S. Portion 30NI or 30NO thereby (a) inhibits the sealing material of wall 34 from spreading inward when portion 30NI is of the so-chosen surface energy or (b) inhibits the wall sealing material from spreading outward when portion 30NO is of the so-chosen surface energy.

After completing the gravitational heating operation, sealed structure 30/32/34/36, including backplate restricting structure 60 and/or backplate restricting structure 62 and also typically tack structures 44, is removed from oven 54. FIG. 7*d* illustrates the sealed flat-panel display at this stage. The sealing material formed with outer wall 34 does not extend significantly laterally beyond restricting structures 60 and 62 when both are present on backplate structure 30. If only one of structures 60 and 62 is present, the wall sealing material does not extend significantly laterally beyond that one of structures 60 and 62 and, if the surface energy of backplate sealing portion 30NO or 30NI opposite that structure 60 or 62 is chosen in the above-described manner, does not extend significantly beyond backplate sealing area 30S. Further operations, which depend (in part) on whether the gravitational heating operation was performed under vacuum or non-vacuum conditions, are performed on the display of FIG. 7*d* in the manner described above for the display of FIG. 2*i*.

Figure 9:
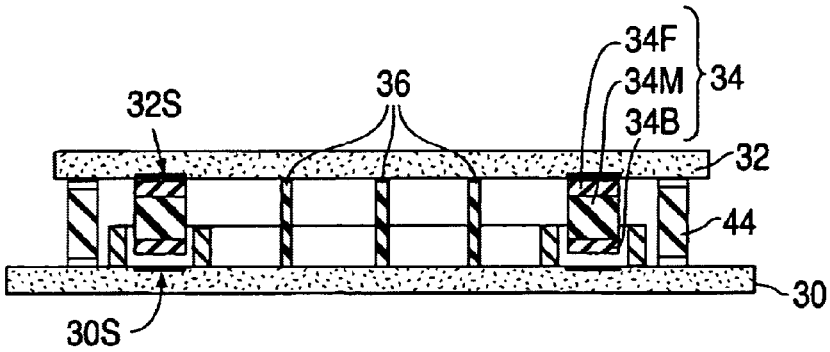
FIG. 9 is a cross-sectional side view of a variation of the faceplate structure, outer wall, and spacer walls in FIG. 7*b*.

As in the flat-panel display sealed according to the process of FIG. 2, outer wall 34 in the display sealed according to the process of FIG. 7 may consist only partly of sealing material that softens and moves downward during the gravitational heating operation. FIG. 9 illustrates a structure containing such a variation of wall 34 for a flat-panel display sealed according to the process of FIG. 7. The structure of FIG. 9 occurs at the stage of FIG. 7*b*. As in the earlier-mentioned variation of FIG. 6, wall 34 in the variation of FIG. 9 consists of main outer wall portion 34M and sealing portions 34B and 34F. Main wall portion 34M again consists of material, such as ceramic, which does not significantly change shape during the gravitational heating operation.

FIGS. 10*a*–10*i* (collectively "FIG. 10") illustrate another process for hermetically sealing a flat-panel display utilizing seal-restricting structures in accordance with the invention. The process of FIG. 10 differs from that of FIG. 7 in that the seal-restricting structures are provided on both of plate structures 30 and 32 in the process of FIG. 10 rather than just on backplate structure 30 as occurs in the process of FIG. 7. Subject to this difference and noting that the process of FIG. 7 begins with the steps of FIGS. 2*a*–2*e*, the steps of FIGS. 10*a*–10*i* respectively parallel the steps of FIGS. 2*a*–2*e* and 7*a*–7*d*.

Figure 10A:
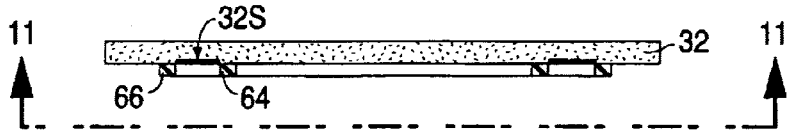
FIGS. 10*a*–10*i* are cross-sectional side views representing steps in another process for sealing a flat-panel display utilizing seal-restricting structures according to the invention.
Figure 10B:
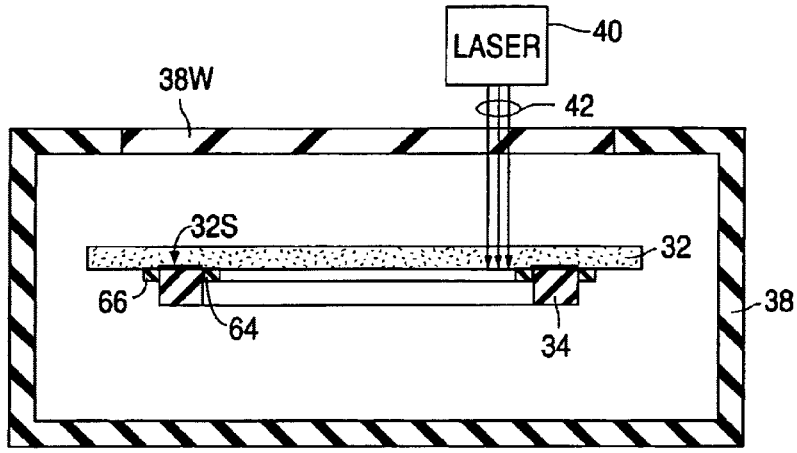
Figure 10C:
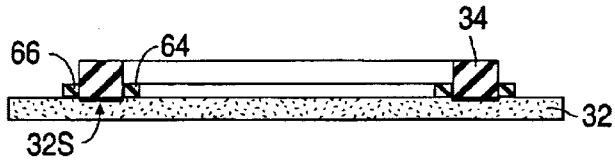

A pair of concentric rectangular annular seal-restricting structures 64 and 66 are provided on the interior surface of faceplate structure 32 as shown in FIG. 10*a*. The combination of faceplate structure 32 and faceplate restricting structures 64 and 66 forms a composite faceplate structure 32/64/66. The rectangular shape of restricting structures 64 and 66 can be seen in FIG. 11 which presents a layout view of composite faceplate structure 32/64/66 at the stage of FIG. 10*a*. As described further below, restricting structures 64 and 66 are positioned in such a way on faceplate structure 32 that restricting structure 64 runs along the inside of outer wall 34 while restricting structure 66 runs along the outside of wall 34. Faceplate sealing area 32S extends between structures 64 and 66.

Faceplate restricting structures 64 and 66 normally (but not necessarily) consist of material largely non-wettable by the sealing material of outer wall 34 relative to sealing area 32S of faceplate structure 32. When wall 34 consists of frit at least along area 32S, restricting structures 64 and 66 are normally constituted in a similar manner to restricting structures 60 and 62 on backplate structure 30. Accordingly, faceplate restricting structures 64 and 66 typically of carbon-containing material, especially hydrocarbon material, when wall 54 consists of frit at least along area 32S. Examples of the carbon-containing material for structures 64 and 66 are polyimide and silicon carbide. Structures 64 and 66 may also consist of silicon nitride or another material which does not contain a significant amount of carbon. Structures 64 and 66 normally have a width (or thickness) measured laterally of 0.2–2 mm, typically 0.5 mm.

Faceplate restricting structures 64 and 66 can be formed in a similar manner to backplate restricting structures 60 and 62. For example, at a suitable stage during the manufacture of composite faceplate structure 32/64/66, a blanket layer of seal-restricting material can be formed on the then-existent interior surface of faceplate structure 32. The formation of the blanket layer of seal-restricting material for faceplate restricting structures 64 and 66 can be done in any of the ways described above for creating the blanket layer of seal-restricting material for backplate restricting structures 60 and 62. Using a suitable photoresist mask, undesired portions of the seal-restricting material are removed to produce faceplate restricting structures 64 and 66.

Alternatively, faceplate restricting structures 64 and 66 can be selectively deposited on the then-existent interior surface of faceplate structure 32 using a shadow mask to prevent the seal-restricting material from accumulating on undesired areas of the then-existent interior surface of structure 32. The shadow mask can be replaced with a photoresist mask formed directly on the then-existent surface of faceplate structure 32 at the locations where no seal-restricting material is desired. After depositing the seal-restricting material, the photoresist mask is removed to remove any seal-restricting material deposited on the mask. Restricting structures 64 and 66 can also be screen printed on the then-existent interior surface of faceplate structure 32.

Faceplate restricting structures 64 and 66 can be created from actinic material by depositing a layer of actinic seal-restricting material on the then-existent interior surface of faceplate structure 32, exposing part of the material to suitable actinic radiation, and removing either the exposed or unexposed actinic material with an appropriate developer. When the actinic material consists of photopolymerizable material, e.g., photopolymerizable precursor polyimide material, the actinic radiation is typically UV light that causes the exposed photopolymerizable precursor material to polymerize. The unexposed photopolymerizable material is then removed with the developer.

Outer wall 34 is placed in oven 38. See FIG. 10*b*. Wall 34 again lies on a suitable support (not shown) in a horizontal position in oven 38. Composite faceplate structure 32/64/66 is placed in oven 38 and positioned on top of wall 34 with the interior surface of faceplate structure 32 facing downward so that wall 34 contacts structure 32 in the space between faceplate restricting structures 64 and 66. Depending on thickness of wall 34 relative to the spacing between restricting structures 64 and 66, wall 34 may contact one or both of structures 64 and 66 at this point. In any event, wall 34 is vertically aligned to faceplate sealing area 32S. As necessary, a suitable alignment system (not shown) is utilized to achieve the requisite alignment.

Only one of faceplate restricting structures 64 and 66 may actually be provided on faceplate structure 32. In that case, outer wall 34 is situated at location close to that one of restricting structures 64 and 66 at the stage of FIG. 10*a*. If only one of restricting structures 64 and 66 is present, that one is typically inner structure 64.

Except as specifically indicated below, the remainder of the description of the process of FIG. 10 is presented below as if faceplate structure 32 were provided with both of restricting structures 64 and 66. To the extent that one of structures 64 and 66 may be absent, a reference to, e.g., a reference symbol denoting, an absent one of structures 64 and 66 is to be ignored in the remainder of the process description of FIG. 10. For instance, a reference to composite faceplate structure 32/64/66 thereby means composite faceplate structure 32/64 if outer restricting structure 66 is absent or composite faceplate structure 32/66 if inner restricting structure 64 is absent.

With composite faceplate structure 32/64/66 suitably aligned to outer wall 34, structure 32/64/66 is sealed to wall 34. The faceplate-structure-to-outer-wall sealing operation is performed in the manner described above in connection with the process of FIG. 2 at the stage of FIG. 2*b*. Hence, after filling oven 38 with dry nitrogen or an inert gas at a pressure close to room pressure, wall 34 is heated so that it softens. In the preferred heating process described above in connection with FIG. 2*b*, wall 34 is raised to a suitable bias temperature after which laser beam 42 of laser 40 is directed along faceplate sealing area 32S so as to cause a thin portion of wall 34 along area 32S to melt. During the subsequent cooldown, wall 34 becomes sealed to composite faceplate structure 32/64/66.

The faceplate-structure-to-outer-wall seal occurs along faceplate sealing area 32S located between faceplate restricting structures 64 and 66. Structures 64 and 66 prevent the sealing material of outer wall 34 from spreading over structures 64 and 66 and contacting faceplate structure 32 laterally beyond structures 64 and 66. In other words, inner restricting structure 64 prevents the wall sealing material from contacting faceplate structure 32 inside inner structure 64 and damaging sensitive elements such as light-emitting elements in the active portion of faceplate structure 32. Outer restricting structure 66 similarly prevents the wall sealing material from contacting faceplate structure 32 outside outer structure 66. The capability to achieve such restriction is typically enhanced by fabricating restricting structures 64 and 66 so as to be largely non-wettable by the wall sealing material.

By appropriately controlling the faceplate-structure-to-outer-wall sealing operation, the wall sealing material normally does not spread laterally to contact inner faceplate restricting structure 64 significantly beyond its outer sidewall or to contact outer faceplate restricting structure 66 significantly beyond its inner sidewall. That is, the wall sealing material normally does not extend significantly over the top of structure 64 or 66. Since structures 64 and 66 furnish physical and/or chemical restraints on the lateral spreading of the sealing material of wall 34 during the faceplate-structure-to-outer-wall sealing operation, the viscosity of wall 34 can change more during the faceplate-strncture-to-outer-wall seal here than in the process of FIG. 2.

When only one of restricting structures 64 and 66 is provided on faceplate structure 32, outer wall 34 contacts faceplate structure 32 close to that one of structures 64 and 66 during the faceplate-structure-to-outer-wall seal. For example, if inner structure 64 is present but outer structure 66 is absent, wall 34 contacts faceplate structure 32 close to the outer sidewall of inner structure 64. On the other hand, if outer structure 66 is present but inner structure 64 is absent, wall 34 contacts faceplate structure 32 close to the inner sidewall of outer structure 66.

Figure 10D:
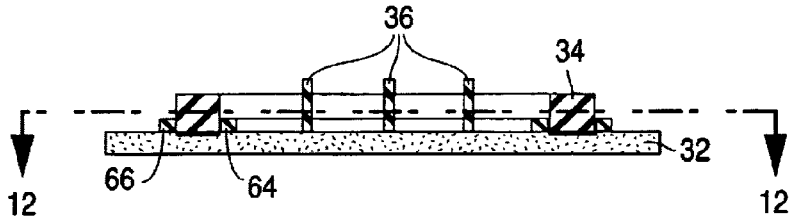
Figure 10E:
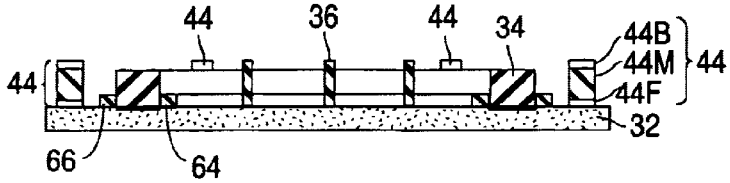
Figure 10F:
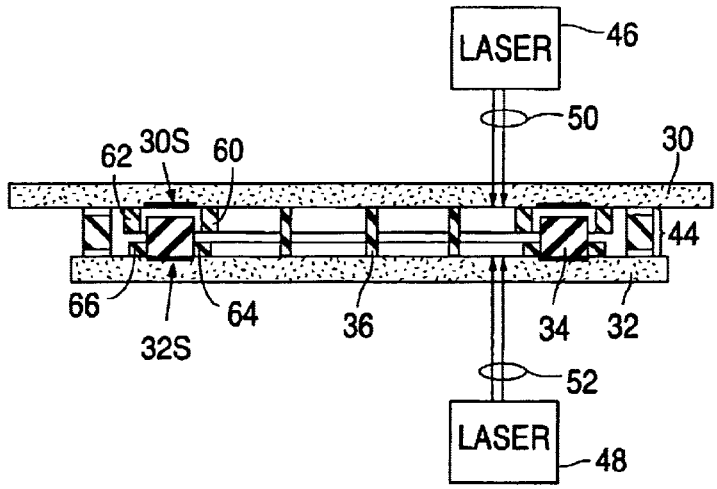

Also, when only one of faceplate restricting structures 64 and 66 is present, faceplate sealing area 32S may be of different surface energy than the portion 32NI or 32NO of the interior surface of faceplate structure 32 extending along and adjoining area 32S and situated on the opposite side of area 32S from that one of structures 64 and 66. For example, if only inner structure 64 is present, area 32S may be of different surface energy than portion 32NO extending along the outside of area 32S. If only outer structure 66 is present, area 32S may be of different surface energy than portion 32NI extending along the inside of area 32S. Although neither of faceplate area portions 30NI and 30NO is indicated in FIG. 10 or 11, the locations of portions 30NI and 30NO are indicated in FIG. 3 which presents a layout view corresponding to that of FIG. 11 but prior to the formation of restricting structures 64 and 66 on faceplate structure 32. Accordingly, FIG. 3 effectively presents a layout view of faceplate structure 32 for the process of FIG. 10 prior to forming restricting structures 64 and 66.

The surface energy of faceplate sealing area 32S promotes bonding of the sealing material of outer wall 34 to area 32S. During the faceplate-structure-to-outer-wall sealing operation, the wall sealing material wets area 32S. When faceplate area portion 32NI or 32NO is of different surface energy than area 32S, the surface energy of portion 32NI or 32NO is chosen to inhibit bonding of the wall sealing material to portion 32NI or 32NO. During the faceplate-structure-to-outer-wall sealing operation, the wall sealing material does not significantly wet portion 32NI or 32NO compared to how the wall sealing material wets area 32S. Portion 32NI or 32NO thereby (a) inhibits the sealing material of wall 34 from spreading inward when portion 32NI is of the so-chosen surface energy or (b) inhibits the wall sealing material from spreading outward when portion 32NO is of the so-chosen surface energy.

After the faceplate-structure-to-outer-wall seal is completed, composite sealed structure 32/34/64/66 is removed from oven 38 or other oven. Structure 32/34/64/66 is oriented so that outer wall 34 is on top of faceplate structure 32, e.g., by flipping structure 32/34/64/66 over if composite faceplate structure 32/64/66 was vertically on top of outer wall 34 during the faceplate-structure-to-outer-wall seal. See FIG. 10*c*.

Figure 12:
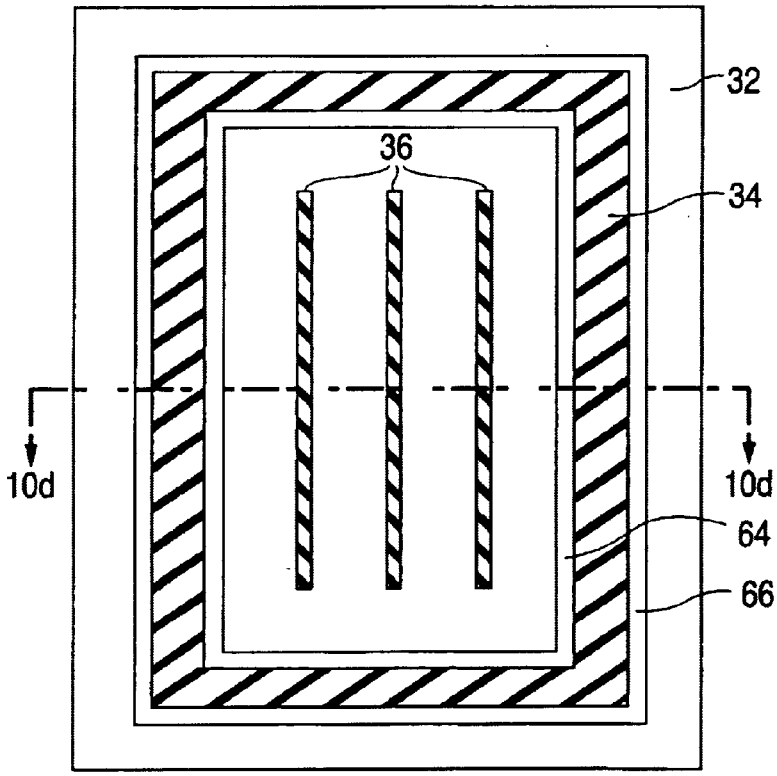
FIG. 12 is a cross-sectional layout view of the faceplate structure, outer wall, and spacer walls in FIG. 10*d*. The cross section of FIG. 10*d* is taken along plane 10*d*—10*d* in FIG. 12. The cross section of FIG. 12 is taken along plane 12—12 in FIG. 10*d*.

Further processing on composite structure 32/34/64/66 is typically conducted in the manner described above in connection with FIGS. 2*d* and 2*e* for the process of FIG. 2. In particular, spacer walls 36 are provided on the interior surface of faceplate structure 32 as shown in FIG. 10*d*. Also see FIG. 12 which presents a plan view of resultant structure 32/34/36/64/66 at the stage of FIG. 10*d*. Tack structures 44 are typically provided on faceplate structure 32 outside outer wall 34 as indicated in FIG. 10*e*. Alternatively, selected ones or all of spacer walls 36 can be tacked to composite faceplate structure 32/64/66 in the manner described above for connecting tacking spacer walls 36 to faceplate structure 32 in the process of FIG. 2.

The remainder of the sealing operation in the process of FIG. 10 is conducted in the manner described above in connection with the of process of FIG. 7. Specifically, seal-restricting structures 60 and 62 are provided on the interior surface of backplate structure 30. Composite backplate structure 30/60/62 is placed on top of composite structure 32/34/36/64/66 as depicted in FIG. 10*f*. The interior surface of backplate structure 30 thereby faces downward with backplate sealing area 30S vertically aligned to outer wall 34. The interior surface of backplate structure 30 contacts spacer walls 36 and bonding pieces 44B of tack structures 44. A gap is again present between wall 34 along all, or largely all, of sealing area 30S. Faceplate restricting structures 64 and 66 are respectively situated opposite backplate restricting structures 60 and 62 but do not contact structures 60 and 62.

Composite backplate structure 30/60/62 is typically tacked to composite structure 32/34/36/64/66 using lasers 46 and 48 in the same manner that lasers 46 and 48 are employed to tack composite backplate structure 30/60/62 to composite structure 32/34/36 in the process of FIG. 7 and thus in the same manner that lasers 46 and 48 are utilized to tack backplate structure 30 to composite structure 32/34/36 in the process of FIG. 2. Upon being struck by laser beams 50 and 52, bonding pieces 44B and 44F of tack structures 44 join structures 44 securely to plate structures 30 and 32. Alternatively, composite backplate structure 30/60/62 can be tacked to composite faceplate structure 32/64/66 (a) along outer wall 34 in the way prescribed above for tacking backplate structure 30 to faceplate structure 32 through outer wall 34 in the process of FIG. 2 or (b) through selected ones or all of spacer walls 36 in the way prescribed above for connecting tacking spacer walls 36 to backplate structure 30 in the process of FIG. 2. Upon being struck by laser beams 50 and 52, bonding pieces 44B and 44F of tack structures 44 join structures 44 securely to plate structures 30 and 32. Alternatively, composite backplate structure 30/60/62 can be tacked to composite face structure 32/64/66 (a) along outer wall 34 in the way prescribed above for tacking backplate structure 30 to faceplate structure 32 through outer wall 34 in the process of FIG. 2 or (b) through selected ones or all of spacer walls 36 in the way prescribed above for connecting tacking spacer walls 36 to backplate structure 30 in the process of FIG. 2.

Figure 10G:
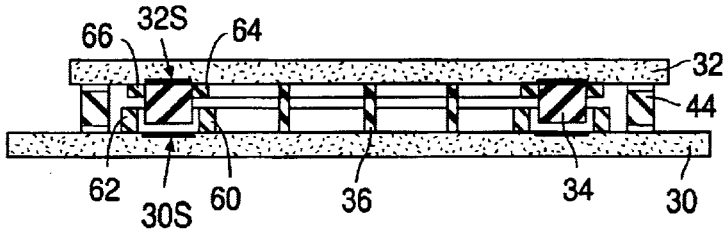
Figure 10H:
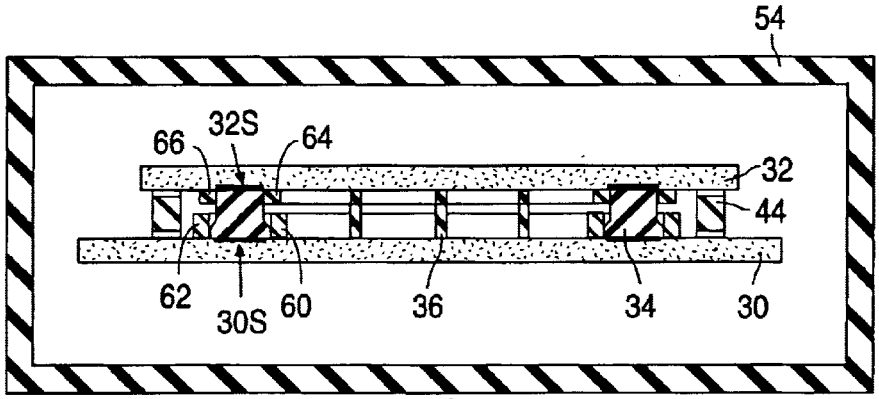
Figure 11:
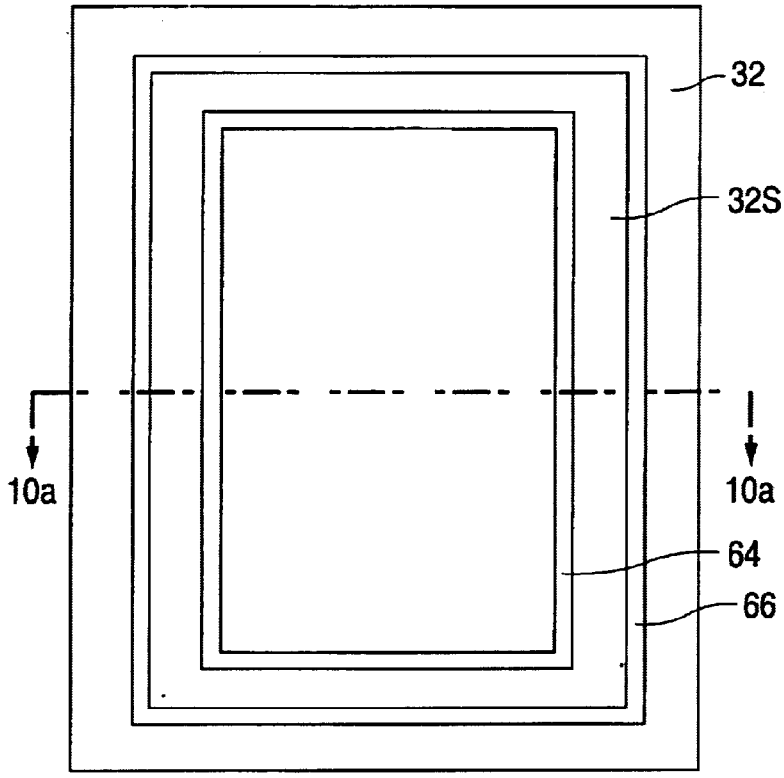
FIG. 11 is a layout view of the faceplate structure in FIG. 10*a*. The cross section of FIG. 10*a* is taken along plane 10*a*—10*a* in FIG. 11. The layout of FIG. 11 appears as viewed from plane 11—11 in FIG. 10*a*.

Tacked, aligned structure 30/32/34/36/60/62/64/66, typically including tack structures 44, is oriented so that faceplate structure 32 is vertically on top as depicted in FIG. 10*g*, e.g., by flipping tacked structure 30/32/34/36/60/62/64/66 over if backplate structure 30 was previously vertically on top, and placed in oven 54. See FIG. 10*h*. As occurs at the corresponding stage of FIG. 2*h* in the process of FIG. 2, or at the corresponding stage of FIG. 7*c* in the process of FIG. 7, backplate structure 30 is positioned vertically below faceplate structure 32 in oven 54 at the stage of FIG. 10*h* with outer wall 34 lying between plate structures 30 and 32. With spacer walls 36 and, when present, tack structures 44 forming an intermediate mechanism that causes plate structures 30 and 32 to be spaced vertically apart from each other in largely a fixed manner, a gravitational heating operation is performed to hermetically seal composite faceplate structure 32/64/66 to composite backplate structure 30/60/62 through outer wall 34. The gravitational heating operation is conducted as described above in connection with FIG. 2 subject to the modifications of FIG. 7 to account for backplate restricting structures 60 and 62.

If (as in the flat-panel display sealed according to process of FIG. 2) restricting structures 64 and 66 were not provided on faceplate structure 32, the sealing material of outer wall 34 would normally not spread significantly laterally over faceplate structure 32 during the gravitational heating operation. Nonetheless, to the extent that such lateral spreading might otherwise occur, inner restricting structure 64 and/or outer restricting structure 66, depending on whether one or both are present, inhibit lateral spreading of the wall sealing material beyond sealing area 32S.

As in the flat-panel display sealed according to the process of FIG. 7, only one of restricting structures 60 and 62 may actually be provided on backplate structure 30 in the flat-panel display sealed according to process of FIG. 10. In that event, all of the comments made above about only one of structures 60 and 62 being present in the process of FIG. 7 apply to the process of FIG. 10. This includes arranging for the surface energy of backplate sealing area 30S to differ from the surface energy of adjoining backplate area portion 32NI or 32NO as described above.

Figure 10I:
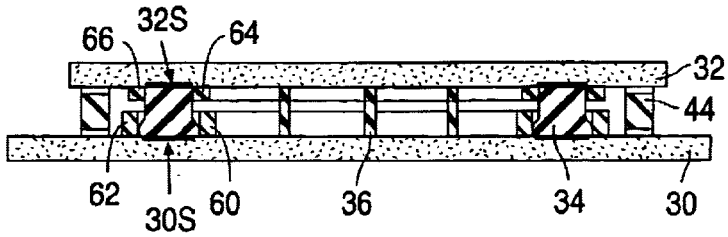

Sealed structure 30/32/34/36, including faceplate inner restricting structure 64 and/or faceplate outer restricting structure 66, backplate inner restricting structure 60 and/or backplate outer restricting structure 62, and also typically tack structures 44, is removed from oven 54 after the gravitational heating operation is completed. The sealed flat-panel display is depicted in FIG. 10*i*. The sealing material formed with outer wall 34 does not extend significantly laterally beyond restricting structure 64 and 66 when both are present on faceplate structure 32. If only one of structures 64 and 66 is present, the wall sealing material does not extend significantly laterally beyond that one of structures 64 and 66 and, if the surface energy of faceplate area portion 32NI or 32NO opposite that structure 64 or 66 is chosen in the above-described manner, does not extend significantly beyond faceplate sealing area 32S. Further operations on the display of FIG. 10*i* are performed as described above for the display of FIG. 2*i*.

All the variations described above for the processes of FIGS. 2 and 7 generally apply to the process of FIG. 10. This includes tacking plate structures 30 and 32 directly together at multiple laterally separated locations along outer wall 34, or through selected ones or all of spacer walls 36, rather than using tack structures 44. Also, outer wall 34 can be configured as described above in connection with FIGS. 6 and 9 so as to consist of main outer wall portion 34M and sealing portions 34B and 34F.

Global-heating Gap-jumping Sealing

Figure 13A:
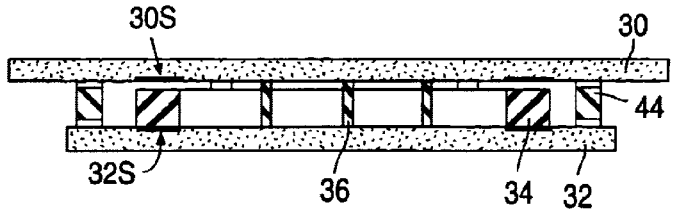
FIGS. 13*a*–13*c* are cross-sectional side views representing steps in part of a process for sealing a flat-panel device using a global-heating gap-jumping technique according to the invention. The process of FIGS. 13*a*–13*c* begins with the steps of FIGS. 2*a*–2*f*.
Figure 13B:
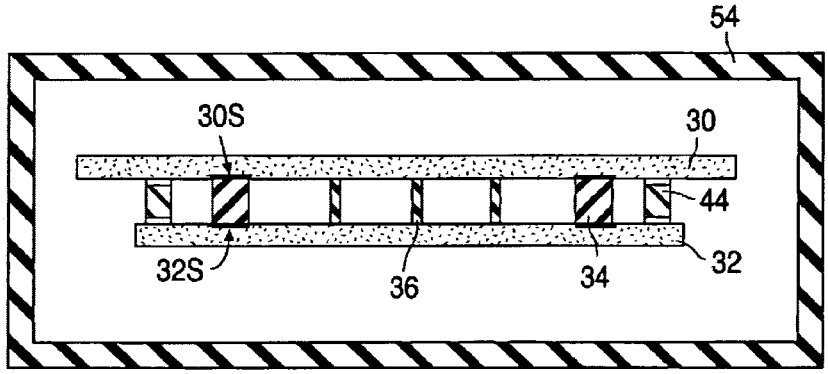
Figure 13C:
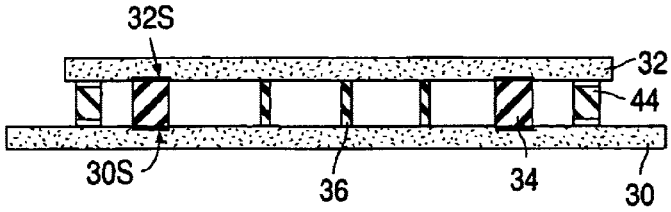

FIGS. 13*a*–13*c* (collectively "FIG. 13") illustrate part of a general global-heating gap-jumping technique for hermetically sealing a flat-panel display according to the invention. The process of FIG. 13 begins with the steps of FIGS. 2*a*–2*f* for creating tacked, aligned structure 30/32/34/36, typically including tack structures 44, as described above. All of the variations to the steps of FIGS. 2*a*–2*f* apply to forming tacked structure 30/32/34/36 for being sealed according to the process of FIG. 13. FIG. 13*a* illustrates how structure 30/32/34/36, here including tack structures 44, appears after the steps of FIGS. 2*a*–2*f* are completed.

Tacked structure 30/32/34/36, typically including tack structures 44, is placed in sealing oven 54. See FIG. 13*b*. Structure 30/32/34/36 can be oriented in various ways in oven 54. Preferably, backplate structure 30 is vertically on top in tacked structure 30/32/34/36. As situated in oven 54, backplate structure 30 is thereby positioned vertically above faceplate structure 32 so that spacer walls 36 and the sealing material formed with outer wall 34 lie between plate structures 30 and 32. This is generally opposite to the orientation of structure 30/32/34/36 during the gravitational heating step in the process of FIG. 2. Structure 30/32/34/36 in the process of FIG. 13 normally extends approximately horizontal at the stage of FIG. 13*b*. However, structure 30/32/34/36 can extend somewhat off-horizontal, typically up to at least 40° off-horizontal, without significantly affecting the backplate-structure-to-outer-wall seal in the process of FIG. 13.

As in the process of FIG. 2, faceplate structure 32 and outer wall 34 in the process of FIG. 13 are spaced apart from backplate structure 30 either along all of backplate sealing area 30S or, when backplate structure 30 is directly tacked to outer wall 34, along largely all of area 30S. Accordingly, a gap again separates wall 34 from backplate structure 30 along all, or largely all, of area 30S. The gap arises because spacer walls 36 extend further away from faceplate structure 32 than does outer wall 34. Spacer walls 36 and, when present, tack structures 44 thereby again form an intermediate system which is situated between plate structure 30 and 32 and which causes structures 30 and 32 to be spaced vertically apart from each other in largely a fixed manner.

The gap between outer wall 34 and backplate structure 30 has an average height which is normally at least 25 $\mu$m. The average height of the gap is typically 75 $\mu$m and can be at least as much as 300 $\mu$m. In the orientation of FIG. 13*b*, the gap runs along the then-existent top edge of wall 34 rather than along the then-existent bottom edge of wall 34 as occurs during the gravitational heating step in the process of FIG. 2.

Tacked structure 30/32/34/36, typically including tack structures 44, in the process of FIG. 13 is globally heated to cause the sealing material of wall 34 to jump the gap and hermetically seal plate structures 30 and 32 together through outer wall 34 as indicated in FIG. 13*b*. During the global-heating gap-jumping operation, wall 34 softens and may even melt along its outside surface. Surface tension causes the softened material of wall 34 to become rounded. The softened material at the upper corners of wall 34 moves toward the longitudinal center of wall 34. In turn, this causes the material along the longitudinal center of wall 34 near backplate structure 30 to move away from faceplate structure 32 so as to meet backplate structure 30 along sealing area 30S. The wall sealing material moves vertically upward in the preferred implementation where backplate structure 30 is vertically above faceplate structure 32.

Gas contained in the softened portions of outer wall 34, or produced as a result of the softening (or melting) of the wall sealing material, may contribute to the upward expansion of wall 34. Also, depending on the composition of wall 34 and on the conditions of the global-heating gap-jumping operation, material along the outer surface of wall 34 may undergo phase change in which the density of that material decreases. The attendant increase in the volume of wall 34 further contributes to the movement of the wall sealing material toward backplate structure 30.

The global-heating gap-jumping operation normally consists of raising structures 30 and 32/34/36, typically including tack structures 44, to a sealing temperature of 300–600° C., preferably 320°–500° C., typically 450° C., for 15–30 min., typically 20 min. Outer wall 34, along with the remainder of tacked structure 30/32/34/36 is subsequently cooled down. During the cooldown, wall 34 becomes hermetically sealed to backplate structure 30 along all of sealing area 30S. In a typical implementation, the temperature in oven 54 is ramped upward from room temperature to 450° C. at 5° C./min., maintained at 450° C. for 20 min., and then ramped downward from 450° C. to room temperature at −5° C./min. The sealing temperature, although sufficiently high to cause the sealing material of wall 34 to soften and sometimes melt or be on the verge of melting along its outside surface, is sufficiently low to avoid significantly damaging any critical components of plate structure 30 or 32 or any of spacer walls 36.

The global-heating gap-jumping operation may be performed at vacuum or non-vacuum conditions. In the non-vacuum case, the global-heating gap-jumping operation is normally done at a pressure close to room pressure in an environment of dry nitrogen or an inert gas such as argon. A typical implementation entails filling oven 54 with dry nitrogen at approximately 710 torr. In the vacuum case, the pressure in oven 54 is typically pumped down to $10^{-6}$ torr or less.

Similar to what occurs during the gravitational heating operation of FIG. 2, the intermediate system formed with spacer walls 36 and, when present, tack structures 44 causes plate structures 30 and 32 in the process of FIG. 13 to remain vertically spaced apart from each other during the global-heating gap-jumping operation in largely the fixed manner established before the global-heating gap-jumping operation. Accordingly, largely no z motion occurs between structures 30 and 32 during the global-heating gap-jumping operation. Alignment degradation that might otherwise occur due to such z motion is largely avoided.

Likewise, the tack system formed with tack structures 44, with the regions where outer wall 34 is directly tacked to backplate structure 30, or with spacer walls 36 when they are used as tacking elements largely prevents plate structures 30 and 32 from moving horizontally relative to each other during the global-heating gap-jumping operation. Hence, structures 30 and 32 remain in largely a fixed positional relationship to each other during the global-heating gap-jumping operation. Backplate sealing area 30S may be of surface energy that promotes bonding of outer wall 34 to area 30S while adjoining backplate area portions 30NI and 30NO are of surface energy that inhibits bonding of wall 34 to portions 30NI and 30NO. In that case, non-sealing portions 30NI and 30NO inhibit the sealing material of outer wall 34 from spreading laterally beyond area 30S during the global-heating gap-jumping operation.

Sealed structure 30/32/34/36, typically including tack structures 44, is removed from oven 54 after the global-heating gap-jumping operation is completed. FIG. 13*c* depicts how the sealed flat-panel display appears at that point. The sealing material formed with outer wall 34 does not extend significantly beyond sealing area 30S of backplate structure 30. Subsequent operations, dependent (in part) on whether the global-heating gap-jumping operation was done under vacuum or non-vacuum conditions, are performed in the way described above for the process of FIG. 2.

Outer wall 34 has been illustrated in FIG. 13 as having a vertical cross-sectional profile that is generally rectangular. However, the vertical cross-sectional profile of wall 34 can have a non-rectangular shape. As one example, the vertical cross-sectional profile of wall 34 at the stage of FIG. 13*a* can be shaped roughly like an inverted trapezoid, preferably an inverted isosceles trapezoid, in which the shorter of the two parallel sides of the trapezoid meets faceplate sealing area 32S. Gap jumping to seal the flat-panel display thereby occurs along the longer of the two parallel sides of the trapezoid. The trapezoidal vertical cross-sectional profile for wall 34 is advantageous because additional wall material for gap jumping is provided at a location close to backplate structure 30.

In the example of FIG. 13*c*, the sealing material of outer wall 34 extends continuously from faceplate structure 32 to backplate structure 30. However, analogous to what was said above about the constituency of wall 34 in the flat-panel display sealed according to the process of FIG. 2, wall 34 in the flat-panel display sealed according of FIG. 13 may consist only partly of sealing material that softens and jumps the gap between wall 34 and backplate structure 30. Wall 34 in the display sealed according to the process of FIG. 13 can be configured as shown in FIG. 6 to consist of main wall portion 34M and sealing portions 34B and 34F.

During the global-heating gap-jumping operation, sealing portion 34B changes shape so as to jump the gap between wall 34 and backplate structure 30. Main portion 34M largely retains its shape during the global-heating gap-jumping operation. Outer wall 34 in this variation may also have a non-rectangular vertical cross-sectional profile, e.g., a roughly trapezoidal vertical cross-sectional profile in which sealing portion 34B is wider laterally than sealing portion 34F. This profile can facilitate gap jumping to seal the display.

Figure 14A:
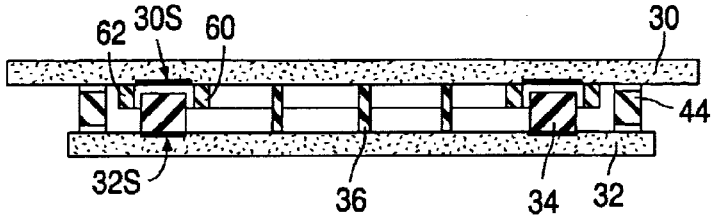
FIGS. 14*a*–14*c* are cross-sectional side views representing steps in part of a process for sealing a flat-panel display using a global-heating gap-jumping technique and seal-restricting structures according to the invention. The process of FIGS. 14*a*–14*c* begins with the steps of FIGS. 2*a*–2*e* and 7*a*.
Figure 14B:
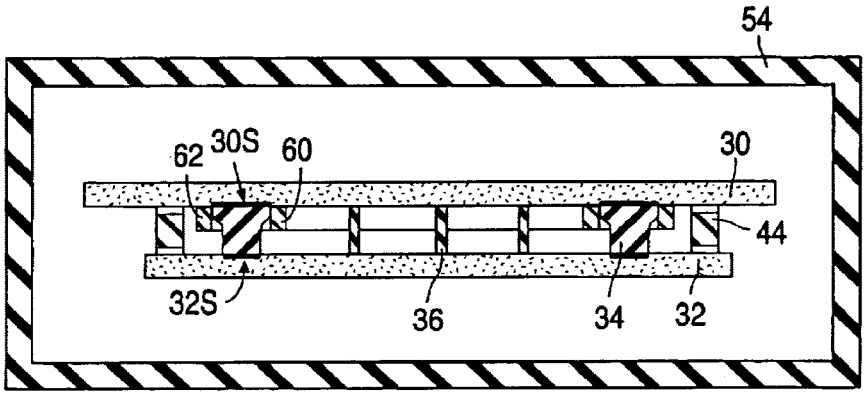
Figure 14C:
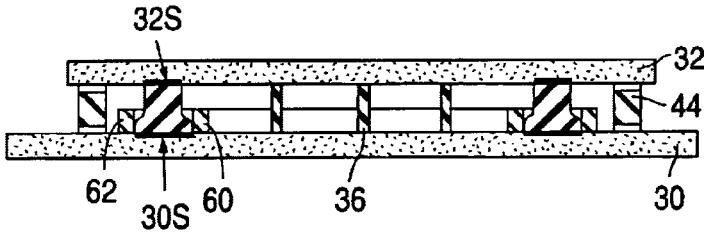

FIGS. 14*a*–14*c* (collectively "FIG. 14") illustrate part of a general process for sealing a flat-panel display using a global-heating gap-jumping technique and backplate seal-restricting structures 60 and 62 in accordance with the invention. The process of FIG. 14 begins with the steps of 2*a*–2*e* for creating composite structure 32/34/36, typically including tack structures 44, followed by the step of FIG. 7*a* for tacking composite backplate structure 30/60/62 consisting of backplate structure 30 and restricting structures 60 and 62 to composite structure 32/34/36 to form tacked, aligned structure 30/32/34/36/60/62. The steps of FIGS. 14*a*–14*c* respectively parallel the steps of FIGS. 13*a*–13*c*. FIG. 14*a* depicts how tacked structure 30/32/34/36/60/62, here including tack structures 44, appears after the steps of FIGS. 2*a*–2*e* and 7*a* are completed.

Tacked structure 30/32/34/36/60/62, typically including tack structures 44, is placed in sealing oven 54. See FIG. 14*b*. All the comments made above about the configuration and orientation of tacked structure 30/32/34/36, including the presence of a gap between backplate structure 30 and outer wall 34, in the process of FIG. 13 after the placement of structure 30/32/34/36 into oven 54 but prior to the global-heating gap-jumping operation apply to the configuration and orientation of structure 30/32/34/36/60/62 at this point in the process of FIG. 14. Hence, backplate structure 30 is preferably vertically above outer wall 34 in the process of FIG. 14 so that the gap between backplate structure 30 and wall 34 runs along the top edge of wall 34 in tacked structure 30/32/34/36/60/62.

Tacked structure 30/32/34/36/60/62 is globally heated as described above for tacked structure 30/32/34/36 at the stage of FIG. 13*b*. The global heating causes the sealing material of outer wall 34 to vertically jump the gap and hermetically seal plate structures 30 and 32 together through wall 34 as indicated in FIG. 14*b*. All the comments made above about the global-heating gap-jumping operation in the process of FIG. 13 apply to the global-heating gap-jumping operation in the process of FIG. 14. This includes the alternative of configuring the vertical cross-sectional profile of wall 34 to be of non-rectangular shape such as an inverted trapezoid at the stage of FIG. 14*a*.

Similarly, the comments made above about backplate restricting structures 60 and 62 during the gravitational heating operation in the process of FIG. 7 generally apply to structures 60 and 62 during the global-heating gap-jumping operation in the process of FIG. 14. In addition, a result of utilizing structures 60 and 62 is that, when at least one of structures 60 and 62 actually laterally restricts the sealing material of outer wall 34 during the global-heating gap-jumping operation, more of the wall sealing material is forced upward toward overlying backplate structure 30 than what would occur if restricting structures 60 and 62 were absent. Consequently, structures 60 and 62 generally enhance the capability to jump the gap. This advantage also typically arises when only one of structures 60 and 62 is present.

Sealed structure 30/32/34/36/60/62 is removed from oven 54 after completing the global-heating gap-jumping operation. See FIG. 14*c* in which, compared to the orientation of structure 30/32/34/36/60/62 in FIG. 14*b*, structure 30/32/34/36/60/62 has been flipped over. Once again, the sealing material of wall 34 does not extend significantly beyond sealing area 30S of backplate structure 30. Subsequent operations are performed as described above for the process of FIG. 2.

Figure 15A:
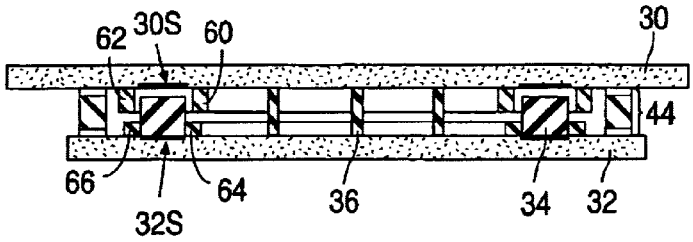
FIGS. 15*a*–15*c* are cross-sectional side views representing steps in part of another process for sealing a flat-panel display using a global-heating gap-jumping technique and seal-restricting structures according to the invention. The process of FIGS. 15*a*–15*c* begins with the steps of FIGS. 10*a*–10*f*.
Figure 15B:
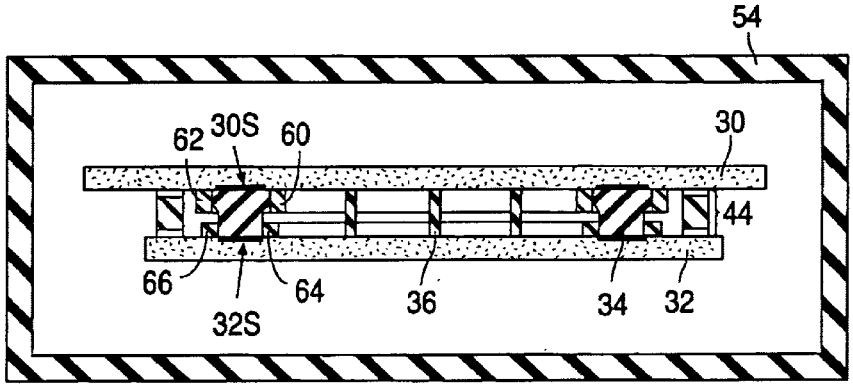
Figure 15C:
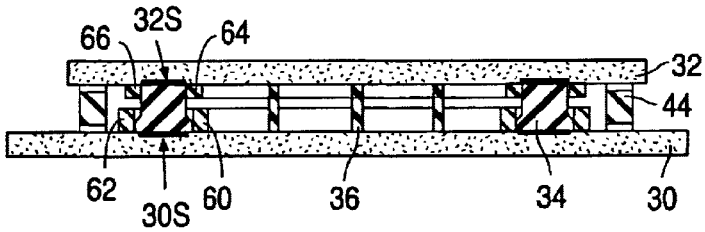

FIGS. 15*a*–15*c* (collectively "FIG. 15") illustrate part of a general procedure for sealing a flat-panel display using a global-heating gap jumping technique, backplate seal-restricting structures 60 and 62, and faceplate seal-restricting structures 64 and 66 in accordance with the invention. The process of FIG. 15 begins with the steps of FIGS. 10*a*–10*f* for creating tacked, aligned structure 30/32/34/36/60/62/64/66, typically including tack structures 44, in which composite backplate structure 30/60/62, again consisting of backplate structure 30 and restricting structures 60 and 62, is tacked to composite faceplate structure 32/64/66 consisting of faceplate structure 32 and restricting structures 64 and 66. The steps of FIGS. 15*a*–15*c* respectively parallel the steps of FIGS. 13*a*–13*c*. FIG. 15*a* depicts how tacked structure 30/32/34/36/60/62/64/66, here including tack structures 44, appears after the steps of FIGS. 10*a*–10*f* are completed.

Tacked structure 30/32/34/36/60/62/64/66, typically including tack structures 44, is placed in sealing oven 54. See FIG. 15*b*. All the comments made above about the configuration and orientation of tacked structure 30/32/34/36, including the presence of a gap between backplate structure 30 and outer wall 34 in the process of FIG. 13 after placement of structure 30/32/34/36 into oven 54 but prior to the global-heating gap-jumping operation apply to the configuration and orientation of tacked structure 30/32/34/36/60/62/64/66 at this point in the process of FIG. 15.

Consequently, backplate structure 30 is preferably vertically above outer wall 34 at this point in the process of FIG. 15 so that the gap between backplate structure 30 and wall 34 runs along the top edge of wall 34 in tacked structure 30/32/34/36/60/62/64/66.

Tacked structure 30/32/34/36/60/62/64/66 is globally heated as described above for tacked structure 30/32/34/36 at the stage of FIG. 13*b*. The global heating causes the sealing material of outer wall 34 to jump the gap and hermetically seal plate structures 30 and 32 together through outer wall 34 as indicated in FIG. 15*b*. All the comments made above about the global-heating gap-jumping operation in the process of FIG. 13 apply to the global-heating gap-jumping operation in the process of FIG. 15.

Similarly, all the comments made above about backplate restricting structures 60 and 62 and faceplate restricting structures 64 and 66 during the gravitational heating operation in the process of FIG. 10 generally apply to structures 60, 62, 64, and 66 during the global-heating gap-jumping operation in the process of FIG. 15. Furthermore, backplate restricting structures 60 and 62 enhance the capability to jump the gap between backplate structure 30 and outer wall 34 in the process of FIG. 15 in the same way as in the process of FIG. 14. This advantage arises if only one of faceplate restricting structures 64 and 66 is present and typically also if only one of backplate restricting structures 60 and 62 is present.

Sealed structure 30/32/34/36/60/62/64/66, including faceplate inner restricting structure 64 and/or faceplate outer restricting structure 66, backplate inner restricting structure 60 and/or backplate outer restricting structure 62, and also typically tack structures 44, is removed from oven 54 after the gravitational heating operation is completed. The sealed flat-panel display is depicted in FIG. 10*i*. The sealing material formed with outer wall 34 does not extend significantly laterally beyond restricting structure 64 and 66 when both are present on faceplate structure 32. If only one of structures 64 and 66 is present, the wall sealing material does not extend significantly laterally beyond that one of structures 64 and 66 and, if the surface energy of faceplate area portion 32NI or 32NO opposite that structure 64 or 66 is chosen in the above-described manner, does not extend significantly beyond faceplate sealing area 32S. Further operations on the display of FIG. 10*i* are performed as described above for the display of FIG. 2*i*.

Variations

While the invention has been described with reference to particular embodiments, this description is solely for purpose of illustration and is not to be construed as limiting the scope of the invention claimed below. For example, outer wall 34 can have a lateral shape other than a rectangular annulus. The sealing of faceplate structure 32 to wall 34 can be performed at orientations other than those shown in FIGS. 2*b* and 10*b*. The tacking of faceplate structure 32 to backplate structure 30 through tack structures 44 can likewise be performed at orientations other than those depicted in FIGS. 2*f*, 7*a*, and 10*f*.

The roles of plate structures 30 and 32 can be reversed in the overall sealing operation. That is, outer wall 34 and spacer walls 36 can be initially joined to backplate structure 30 rather than to faceplate structure 32. In that case, spacer walls 36 in resultant composite structure 30/34/36 extend further away from backplate structure 30 than does outer wall 34. Faceplate structure 32 is then placed on composite structure 30/34/36, appropriately aligned to structure 30/34/36, and tacked to backplate structure 30. The tacking operation can be performed with tack structures 44, along multiple laterally separated portions of outer wall 34, or through selected ones or all of spacer walls 36. Because spacer walls 36 are taller than outer wall 34, a gap separates faceplate structure 32 from outer wall 34.

To complete the sealing operation, tacked structure 30/32/34/36 can be oriented in sealing oven 54 so that backplate structure 30 is vertically above outer wall 34. The gap between outer wall 34 and faceplate structure 32 is then present along the then-existent bottom edge of wall 34. Subject to the roles of plate structures 30 and 32 being reversed, a gravitational heating operation is performed on structure 30/32/34/36 as generally described above for the process of FIG. 2. This causes the sealing material of wall 34 to move downward under gravitational influence to meet faceplate structure 32 and hermetically seal the flat-panel display.

Alternatively, tacked structure 30/32/34/36 can be oriented in oven 54 so that faceplate structure 32 is vertically above outer wall 34. With structure 30/32/34/36 SO oriented, the gap between outer wall 34 and faceplate structure 32 is present along the then-existent top edge of wall 34. Subject again to the roles of plate structures 30 and 32 being reversed, a global-heating gap-jumping operation is performed on structure 30/32/34/36 as generally described above for the process of FIG. 13. The sealing material of wall 34 then moves vertically upward to jump the gap and hermetically seal the display.

One or both of backplate restricting structures 60 and 62 may be provided on backplate structure 30 in the situation where the roles of plate structures 30 and 32 are reversed. Similarly, one or both of faceplate restricting structures 64 and 66 may be provided on faceplate structure 32 in this situation. Because the roles of plates structures 30 and 32 are reversed, backplate restricting structures 64 and 66 restrict the lateral movement of the wall sealing material as it moves vertically, whether downward or upward, across the gap between outer wall 34 and faceplate structure 32. Hence, the roles of backplate restricting structures 64 and 66 are basically reversed from the roles of faceplate restricting structures 60 and 62, and vice versa.

Outer wall 34 can be initially joined to one of plate structures 30 and 32 with spacer walls 36 being initially joined to the other of structures 30 and 32. Backplate structure 30, now connected either to outer wall 34 or to spacer walls 36, is aligned and tacked to faceplate structure 30, now connected either to spacer walls 36 or to outer wall 34. Depending on which of these two alternatives is utilized, a gap is present either between outer wall 34 and backplate structure 30 or between outer wall 34 and faceplate structure 32.

Tacked, aligned structure 30/32/34/36 in the alternative described in the preceding paragraph can be oriented so that the gap runs along the then-existent bottom edge of outer wall 34. A gravitational sealing operation is then performed as generally described above for the process of FIG. 2 to close the gap and seal the flat-panel display. Alternatively, tacked structure 30/32/34/36 can be oriented so that the gap runs along the then-existent top edge of wall 34. In that case, a global-heating gap-jumping operation as generally described above for the process of FIG. 13 is utilized to close the gap and seal the display. One or more of seal-restricting structures 60, 62, 64, and 66 can be utilized in either of these two variations.

As mentioned above, the gravitational heating operation of the invention can be performed by locally heating outer wall 34 rather than globally heating tacked structure 30/32/34/36. Energy is then transferred locally to the sealing material of wall 34 so as to cause the wall sealing material to move vertically downward and seal plate structures 30 and 32 together through wall 34. This variation can, of course, be employed when faceplate structure 32 is tacked to backplate structure 30 through selected ones or all of spacer walls 36.

When global-heating gap-jumping is utilized to seal backplate structure 30 to faceplate structure 32 after tacking faceplate structure 32 to backplate structure 30 through selected ones or all of spacer walls 36, it can sometimes be advantageous to substitute local heating of wall 34 for global heating of tacked structure 30/32/34/36. That is, after faceplate structure 32 is tacked to backplate structure 30 through selected ones or all of spacer walls 36 so that a gap is present between backplate structure 30 and composite structure 32/34/36, energy is transferred locally to the sealing material of outer wall 34 to cause the wall sealing material to jump the gap and hermetically seal backplate structure 30 to faceplate structure 32 through outer wall 34. The wall sealing material moves vertically upward to meet backplate structure 30 in the preferred embodiment where backplate structure 30 is vertically on top in tacked structure 30/32/34/36.

The local energy transferred to outer wall 34 to cause gap jumping when faceplate structure 32 is tacked to backplate structure 30 through selected ones or all of spacer walls 36 is typically light energy provided by a laser or focused lamp. As occurs when the present gravitational heating operation is performed by local energy transfer, the local energy can be microwave or IR energy provided from a source that suitably focuses the local energy. Further details on using local energy to hermetically seal a flat-panel display are presented in PCT Patent Publication WO 98/26440, cited above, the contents of which are incorporated by reference herein.

The above-mentioned variations dealing with role reversal and so on generally apply to situations in which local heating of outer wall 34 is utilized to seal backplate structure 30 to composite structure 32/34/36 after tacking backplate structure 30 to faceplate structure 32 through selected ones or all of spacer walls 36. For example, the roles of plate structures 30 and 32 can be reversed so that outer wall 34 and spacer walls 36 are initially joined to backplate structure 30 rather than to faceplate structure 32. Similarly, outer wall 34 can be initially joined to one of plate structures 30 and 32 while spacer walls 36 are initially joined to the other of structures 30 and 32. Also, one or both of seal-restricting structures 60 and 62 can be provided on backplate structure 30. One or both of seal-restricting structure 64 and 66 can be provided on faceplate structure 32.

Spacer walls 36 in the internal spacer system can be replaced with spacers having shapes other than generally flat walls. Alternative shapes for such spacers include posts and combinations of spacer walls. As viewed perpendicular to plate structure 30 or 32, a spacer post can, e.g., be of rectangular or circular shape. A spacer formed with multiple walls can, as viewed perpendicular to plate structure 30 or 32, be shaped like a "T", an "L", an "H", and so on.

Under certain circumstances, a flat-panel display manufactured according to the invention may not have an internal spacer system for maintaining a largely constant spacing between plate structures 30 and 32 and for preventing external forces, especially air pressure, from damaging the display. For instance, the display may be of sufficiently small lateral area that an internal spacer system is not necessary. Alternatively or additionally, plate structures 30 and 32 may be sufficiently strong on their own to withstand air pressure and other such external forces. See U.S. Pat. No. 5,964,630 for examples of flat-panel CRT displays not having internal spacer systems.

Should a spacer system not be present between plate structures 30 and 32 or, although present, not be utilized to produce a gap between outer wall 34 and either plate structure 30 or 32 prior to the gravitational heating or global-heating gap-jumping operation of the invention, the gap can be established by tack structures 44 when they are present. Alternatively, the gap can be established by another mechanism situated outside wall 34. As an example, an alignment system can be utilized to clamp structures 30 and 32 so as to establish the gap and hold structures 30 and 32 in a substantially fixed position relative to each other during the gravitational heating or global-heating gap-jumping operation. An external spacer system consisting of one or more external spacers may be strategically placed between structures 30 and 32 outside wall 34. The external spacer system may, as with tack structures 44, remain in the sealed flat-panel display or may be removed from the display.

The invention can be employed to hermetically seal flat-panel devices other than displays. Examples include (a) microchannel plates in high-vacuum cells similar to photo multipliers, (b) micromechanical packages for devices such as accelerometers, gyroscopes, and pressure sensors, and (c) packages for biomedical implants. Various modifications and applications may thus be made by those skilled in the art without departing from the true scope and spirit of the invention as defined in the appended claims.

We claim:

1. A method comprising the steps of:

positioning first and second plate structures generally opposite each other such that a restricting structure provided over the first plate structure lies between the plate structures and such that sealing material provided in a specified pattern over the second plate structure lies between the plate structures and is situated at a location close to the restricting structure; and heating the sealing material to seal the plate structures together such that the sealing material contacts the first plate structure close to the restricting structure and such that the restricting structure largely prevents the sealing material from spreading laterally over the restricting structure to contact the first plate structure laterally beyond the restricting structure, the restricting structure being sufficiently short as to be spaced apart from the second plate structure subsequent to the heating step.

2. A method as in claim 1 wherein the sealing material does not spread significantly over the restricting structure during the heating step.

3. A method as in claim 2 wherein the sealing material is situated sufficiently close to the restricting structure during the positioning step that the sealing material laterally contacts the restricting structure during the heating step.

4. A method as in claim 1 wherein the restricting structure consists of material not significantly wettable by the sealing material.

5. A method as in claim 1 wherein the restricting structure is largely of laterally annular shape, the sealing material contacting the first plate structure at a location largely outside the restricting structure during the heating step.

6. A method as in claim 1 wherein:

the positioning step entails positioning the first plate structure vertically below the second plate structure; and the sealing material moves vertically downward under gravitational influence during the heating step.

7. A method as in claim 1 wherein the heating step comprises globally heating the sealing material, the plate structures, and the restricting structure.

8. A method as in claim 7 wherein:

the positioning step entails positioning the first plate structure vertically above the second plate structure such that a gap at least partially separates the sealing material from the first plate structure; and the sealing material jumps the gap during the heating step.

9. A method as in claim 1 wherein the positioning step includes arranging for the plate structures to be spaced apart from each other in largely a fixed manner such that the plate structures are spaced apart from each other in largely that fixed manner during the heating step.

10. A method as in claim 9 wherein the positioning step includes placing intermediate means, other than the sealing material or the restricting structure, between the plate structures such that the intermediate means contacts both plate structures.

11. A method as in claim 1 wherein:

the method further includes, prior to the positioning step, the step of providing a further restricting structure over the second plate structure such that the sealing material is situated over the second plate structure opposite a location close to the further restricting structure; and the further restricting structure largely prevents the sealing material from spreading laterally over the further restricting structure to contact the second plate structure laterally beyond the further restricting structure during the heating step.

12. A method as in claim 1 wherein the second plate structure has (a) a sealing area which contacts the sealing material and is of a surface energy that promotes bonding of the sealing material to the sealing area and (b) a further area which laterally adjoins the sealing area and is of a surface energy that inhibits bonding of the sealing material to the further area.

13. A method as in claim 1 wherein, after the heating step is completed, the sealing material extends continuously from each plate structure to the other plate structure.

14. A method as in claim 1 wherein:

an outer wall portion has opposite first and second edges respectively covered by first and second parts of the sealing material; and the outer wall portion is provided over the second plate structure prior to the positioning step such that the second part of the sealing material joins the second plate structure to the outer wall portion along its second edge.

15. A method as in claim 1 wherein the plate structures are components of a flat-panel display.

16. A method as in claim 15 wherein the flat-panel display is flat-panel cathode-ray tube display.

17. A method as in claim 1 wherein the sealing material is largely of laterally annular shape.

18. A method as in claim 1 wherein, subsequent to the heating step, the sealing material has a vertical cross-sectional profile shaped generally like a rectangle.

19. A method as in claim 1 wherein, subsequent to the heating step, the sealing material has a vertical cross-sectional profile having (a) a first side that meets the first plate structure and (b) a second side that meets the second plate structure, extends generally parallel to the first side, and is shorter than the first side.

20. A method as in claim 1 wherein, prior to the heating step, the sealing material has a vertical cross-sectional profile having a first side and a second side that meets the second plate structure, extends generally parallel to the first side, and is shorter than the first side.

21. A method as in claim 20 wherein the vertical cross-sectional profile of the sealing material prior to the heating step is shaped generally like a trapezoid whose two parallel sides respectively constitute the aforementioned first and second sides.

22. A method as in claim 21 wherein the trapezoid is an isosceles trapezoid.

23. A method comprising the steps of:

positioning first and second plate structures generally opposite each other such that a pair of restricting structures provided over the first plate structure lie between the plate structures and such that sealing material provided in a specified pattern over the second plate structure lies between the plate structures and is situated opposite a location between the restricting structures; and heating the sealing material to seal the plate structures together such that the sealing material contacts the first plate structure between the restricting structures and such that the restricting structures largely prevent the sealing material from spreading over the restricting structures to contact the first plate structure laterally beyond the restricting structures.

24. A method as in claim 23 wherein the sealing material does not spread significantly over the restricting structures during the heating step.

25. A method as in claim 24 wherein the sealing material is situated sufficiently close to the restricting structures during the positioning step that the sealing material laterally contacts at least one of the restricting structures during the heating step.

26. A method as in claim 23 wherein the restricting structures consist of material not significantly wettable by the sealing material.

27. A method as in claim 23 wherein the sealing material is largely of laterally annular shape.

28. A method as in claim 27 wherein each restricting structure is largely of laterally annular shape.

29. A method as in claim 23 wherein:

the positioning step entails positioning the first plate structure vertically below the second plate structure; and the sealing material moves vertically downward under gravitational influence during the heating step.

30. A method as in claim 23 wherein the heating step comprises globally heating the sealing material, the plate structures, and the restricting structures.

31. A method as in claim 30 wherein:

the positioning step entails positioning the first plate structure vertically above the second plate structure such that a gap at least partially separates the sealing material from the first plate structure; and the sealing material jumps the gap during the heating step.

32. A method as in claim 23 wherein the plate structures are maintained in a largely fixed positional relationship to each other during the heating step.

33. A method as in claim 23 wherein the positioning step includes arranging for the plate structures to be spaced apart from each other in largely a fixed manner such that the plate structures are spaced apart from each other in largely that fixed manner during the heating step.

34. A method as in claim 33 wherein the arranging step includes placing intermediate means, other than the sealing material or the restricting structures, between the plate structures such that the intermediate means contacts both plate structures.

35. A method as in claim 34 wherein the intermediate means comprises tack means through which the plate structures are coupled together at multiple locations spaced laterally apart along the plate structures.

36. A method as in claim 34 wherein the sealing material is largely of laterally annular shape, the intermediate means comprising spacer means situated inside the sealing material.

37. A method as in claim 23 wherein the positioning step includes arranging for spacer means to be situated between the plate structures so that the second plate structure and the sealing material are vertically spaced apart from the first plate structure along largely all of the sealing material prior to the heating step.

38. A method as in claim 37 wherein the spacer means causes the plate structures to be spaced apart from each other in largely a fixed manner during the heating step.

39. A method as in claim 23 further including, between the positioning and heating steps, the step of joining the sealing material to the first plate structure at multiple locations spaced laterally apart along the first plate structure.

40. A method as in claim 39 wherein the joining step entails directing energy locally onto the sealing material at multiple laterally separated seal locations respectively corresponding to the multiple locations along the first plate structure.

41. A method as in claim 23 wherein:

the method further includes, prior to the positioning step, the step of providing a pair of further restricting structures over the second plate structure such that the sealing material is situated over the second plate structure opposite a location between the further restricting structures; and the further restricting structures largely prevent the sealing material from spreading laterally over the further restricting structures to contact the second plate structure laterally beyond the further restricting structures during the heating step.

42. A method as in claim 23 wherein the second plate structure has (a) a sealing area which contacts the sealing material and is of a surface energy that promotes bonding of the sealing material to the sealing area and (b) a further area which laterally adjoins the sealing area and is of a surface energy that inhibits bonding of the sealing material to the further area.

43. A method as in claim 23 wherein, subsequent to the heating step, the sealing material has a vertical cross-sectional profile shaped generally like a rectangle.

44. A method as in claim 23 wherein, subsequent to the heating step, the sealing material has a vertical cross-sectional profile having (a) a first side that meets the first plate structure and (b) a second side that meets the second plate structure, extends generally parallel to the first side, and is shorter than the first side.

45. A method comprising the steps of:

positioning a first plate structure generally opposite a second plate structure such that sealing material provided in a specified pattern over the second plate structure lies between the plate structures, such that a gap at least partially separates the sealing material from the first plate structure, and such that spacer means (a) lies between the plate structures, (b) is largely laterally surrounded by the sealing material, and (c) is rigidly coupled to both plate structures at multiple locations spaced laterally apart along the plate structures; and transferring energy locally to the sealing material to cause the sealing material to close the gap and seal the plate structures together.

46. A method as in claim 45 wherein the spacer means comprises multiple spacers spaced laterally apart from one another.

47. A method as in claim 45 wherein the spacer means causes the plate structures to be spaced apart from each other in largely a fixed manner during the energy-transferring step.

48. A method as in claim 45 wherein the energy comprises light energy.

49. A method as in claim 45 wherein the first plate structure lies vertically below the second plate structure during the energy-transferring step such that the sealing material moves vertically downward under gravitational influence to contact the first plate structure during the energy-transferring step.

50. A method as in claim 45 wherein the first plate structure lies vertically above the second plate structure during the energy-transferring step such that the sealing material moves vertically upward to bridge the gap during the energy-transferring step.

51. A method as in claim, 50 wherein the gap has an average height of at least 25 $\mu$m.

52. A method as in claim 45 wherein:

the positioning step entails the positioning the plate structures such that a restricting structure provided over the first plate structure lies between the plate structures and such that the sealing material is situated at a location close to the restricting structure; and the sealing material contacts the first plate structure close to the restricting structure during the energy-transferring step and is largely prevented by the restricting structure from spreading laterally over the restricting structure to contact the first plate structure laterally beyond the restricting structure.

53. A method as in claim 52 wherein:

the method further includes, prior to the positioning step, the step of providing a further restricting structure over the second plate structure such that the sealing material is situated over the second plate structure opposite a location close to the further restricting structure; and the further restricting structure largely prevents the sealing material from spreading laterally over the further restricting structure to contact the second plate structure laterally beyond the further restricting structure during the energy-transferring step.

54. A method as in claim 45 wherein:

the positioning step entails positioning the plate structures such that a pair of restricting structures provided over the first plate structure lie between the plate structures and such that the sealing material is situated opposite a location between the restricting structures; and the sealing material contacts the first plate structure between the restricting structures during the energy-transferring step and is largely prevented by the restricting structures from spreading laterally over the restricting structures to contact the first plate structure laterally beyond the restricting structures.

55. A method as in claim 45 wherein the sealing material is largely of laterally annular shape.

56. A method comprising the steps of:

positioning a first plate structure vertically below a second plate structure such that sealing material provided in a specified pattern over the second plate structure lies between the plate structures; and heating the sealing material so that it moves generally downward under gravitational influence to contact the first plate structure and seal the plate structures together, the first plate structure having (a) a sealing area which contacts the sealing material during the heating step and is of a surface energy that promotes bonding of the sealing material to the sealing area and (b) a further area which laterally adjoins the sealing area and is of a surface energy that inhibits bonding of the sealing material to the further area.

57. A method as in claim 56 wherein the plate structures are maintained in largely a fixed positional relationship to each other during the heating step.

58. A method as in claim 56 one wherein the heating step comprises globally heating the sealing material and the plate structures.

59. A method as in claim 56 wherein the plate structures are components of a flat-panel display.

60. A method as in claim 59 wherein the flat-panel display is a flat-panel cathode-ray tube display.

61. A method comprising the steps of:

positioning a first plate structure vertically below a second plate structure such that sealing material provided in a specified pattern over the second plate structure lies between the plate structures; and heating the sealing material so that it moves generally downward under gravitational influence to contact the first plate structure and seal the plate structures together, the second plate structure having (a) a sealing area which contacts the sealing material and is of a surface energy that promotes bonding of the sealing material to the sealing area and (b) a further area which laterally adjoins the sealing area and is of a surface energy that inhibits bonding of the sealing material to the further area.

62. A method as in claim 61 wherein the first plate structure has (a) a sealing area which contacts the sealing material during the heating step and is of a surface energy that promotes bonding of the sealing material to the first plate structure's sealing area and (b) a further area which laterally adjoins the first plate structure's sealing area and is of a surface energy that inhibits bonding of the sealing material to the first plate structure's sealing area.

63. A method as in claim 61 wherein the plate structures are maintained in largely a fixed positional relationship to each other during the heating step.

64. A method as in claim 61 one wherein the heating step comprises globally heating the sealing material and the plate structures.

65. A method as in claim 61 wherein the plate structures are components of a flat-panel display.

66. A method as in claim 65 wherein the flat-panel display is a flat-panel cathode-ray tube display.

67. A method comprising the steps of:

positioning first and second plate structures generally opposite each other such that a restricting structure provided over the first plate structure lies between the plate structures, such that sealing material provided in a specified pattern over the second plate structure lies between the plate structures and is situated at a location close to the restricting structure, and such that intermediate means, other than the sealing material or the restricting structure, lies between the plate structures and contacts both plate structures; and heating the sealing material to seal the plate structures together such that the sealing material contacts the first plate structure close to the restricting structure and such that the restricting structure largely prevents the sealing material from spreading laterally over the restricting structure to contact the first plate structure laterally beyond the restricting structure.

68. A method as in claim 67 wherein the intermediate means comprises tack means through which the plate structures are coupled together at multiple locations spaced laterally apart along the plate structures.

69. A method as in claim 68 wherein the sealing material is largely of laterally annular shape, the tack means being situated outside the sealing material.

70. A method as in claim 67 wherein the sealing material is largely of laterally annular shape, the intermediate means comprising spacer means situated inside the sealing material.

71. A method as in claim 70 wherein the intermediate means further includes tack means through which the plate structures are coupled together at multiple locations spaced laterally apart along the plate structures.

72. A method as in claim 67 wherein the sealing material is situated sufficiently close to the restricting structure during the positioning step that the sealing material laterally contacts the restricting structure during the heating step.

73. A method as in claim 67 wherein:

the positioning step entails positioning the first plate structure vertically below the second plate structure; and the sealing material moves vertically downward under gravitational influence during the heating step.

74. A method as in claim 67 wherein the heating step comprises globally heating the sealing material, the plate structures, and the restricting structure.

75. A method as in claim 74 wherein:

the positioning step entails positioning the first plate structure vertically above the second plate structure such that a gap at least partially separates the sealing material from the first plate structure; and the sealing material jumps the gap during the heating step.

76. A method as in claim 67 wherein, subsequent to the heating step, the sealing material has a vertical cross-sectional profile shaped generally like a rectangle.

77. A method as in claim 67 wherein, subsequent to the heating step, the sealing material has a vertical cross-sectional profile having (a) a first side that meets the first plate structure and (b) a second side that meets the second side plate structure, extends generally parallel to the first side, and is shorter than the first side.

78. A method comprising the steps of:

positioning first and second plate structures generally opposite each other such that a first restricting structure provided over the first plate structure lies between the plate structures, such that a second restricting structure provided over the second plate structure lies between the plate structures, and such that sealing material provided in a specified pattern over the second plate structure lies between the plate structures, is situated at a location close to the first restricting structure, and is situated opposite a location close to the second restricting structure; and heating the sealing material to seal the plate structures together such that the sealing material contacts the first plate structure close to the first restricting structure, such that the first restricting structure largely prevents the sealing material from spreading laterally over the first restricting structure to contact the first plate structure laterally beyond the first restricting structure, and such that the second restricting structure largely prevents the sealing material from spreading laterally over the second restricting structure to contact the second plate structure laterally beyond the second restricting structure.

79. A method as in claim 78 wherein the sealing material is situated sufficiently close to the restricting structures during the positioning step that the sealing material laterally contacts the restricting structures during the heating step.

80. A method as in claim 78 wherein:

the positioning step entails positioning the first plate structure vertically below the second plate structure; and the sealing material moves vertically downward under gravitational influence during the heating step.

81. A method as in claim 78 wherein the heating step comprises globally heating the sealing material, the plate structures, and the restricting structures.

82. A method as in claim 81 wherein:

the positioning step entails positioning the first plate structure vertically above the second plate structure such that a gap at least partially separates the sealing material from the first plate structure; and the sealing material jumps the gap during the heating step.

83. A method as in claim 78 wherein, subsequent to the heating step, the sealing material has a vertical cross-sectional profile shaped generally like a rectangle.

84. A method as in claim 78 wherein, subsequent to the heating step, the sealing material has a vertical cross-sectional profile having (a) a first side that meets the first plate structure and (b) a second side that meets the second side plate structure, extends generally parallel to the first side, and is shorter than the first side.

* * * * *